US011263958B2

(12) United States Patent
Zhai et al.

(10) Patent No.: US 11,263,958 B2
(45) Date of Patent: Mar. 1, 2022

(54) PIXEL DRIVING CIRCUIT AND DRIVING METHOD IMPROVING STABILITY OF PIXEL DRIVING CIRCUIT IN DRIVING LIGHT EMITTING ELEMENT

(71) Applicant: Shanghai Tianma AM-OLED Co., Ltd., Shanghai (CN)

(72) Inventors: Yingteng Zhai, Shanghai (CN); Chenhang Sheng, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 16/944,106

(22) Filed: Jul. 30, 2020

(65) Prior Publication Data

US 2020/0365078 A1 Nov. 19, 2020

(30) Foreign Application Priority Data

May 29, 2020 (CN) ..... 202010474083.3

(51) Int. Cl.
*G09G 3/32* (2016.01)

(52) U.S. Cl.
CPC ..... *G09G 3/32* (2013.01); *G09G 2310/061* (2013.01); *G09G 2320/064* (2013.01); *G09G 2320/0633* (2013.01)

(58) Field of Classification Search
CPC ..... G09G 3/30; G09G 3/32; G09G 3/3208; G09G 3/3216; G09G 3/3225; G09G 3/3233; G09G 3/3241; G09G 3/325; G09G 3/3258; G09G 3/3291; G09G 2320/062; G09G 2320/0626; G09G 2320/0633; G09G 2320/064
USPC ..... 345/76–83
See application file for complete search history.

(56) References Cited

U.S. PATENT DOCUMENTS 7,623,123 B2 * 11/2009 Kim ..... G09G 3/2011 345/204
11,043,188 B2 * 6/2021 Zhai ..... G09G 3/3208
2001/0019319 A1 * 9/2001 Kim ..... G09G 3/3233 345/77
2014/0362062 A1 * 12/2014 Limketkai ..... G09G 3/325 345/205
2018/0151132 A1 * 5/2018 Lee ..... G09G 3/3406
2018/0182279 A1 * 6/2018 Sakariya ..... G09G 3/32
(Continued)

FOREIGN PATENT DOCUMENTS

CN 110556072 A 12/2019

*Primary Examiner* — Alexander Eisen
*Assistant Examiner* — Nelson Lam
(74) *Attorney, Agent, or Firm* — Kilpatrick Townsend & Stockton, LLP

(57) ABSTRACT

A pixel driving circuit and a driving method thereof, a display panel and a display device are provided. A second light emitting control device controls, in a case that a first light emitting control device controls a floating signal to be transmitted to a gate of a drive transistor for a first predetermined time period, a driving current to be transmitted to a light emitting element, and the light emitting element can emit light. In this way, the light emitting element can be driven to emit light after a fluctuation period of a voltage of the gate of the drive transistor during which the floating signal is initially inputted to the gate of the drive transistor is passed, improving the stability of the pixel driving circuit in driving the light emitting element.

19 Claims, 14 Drawing Sheets

(56) References Cited

U.S. PATENT DOCUMENTS

| | | | | |
|---|---|---|---|---|
| 2018/0301080 | A1* | 10/2018 | Shigeta | G09G 3/3208 |
| 2019/0371231 | A1 | 12/2019 | Kim | |
| 2019/0371232 | A1* | 12/2019 | Kim | G09G 3/32 |
| 2020/0111403 | A1* | 4/2020 | Kim | G09G 3/2003 |
| 2020/0111404 | A1* | 4/2020 | Kim | G09G 3/2003 |
| 2020/0312216 | A1* | 10/2020 | Kim | G09G 3/2014 |
| 2020/0394953 | A1* | 12/2020 | Kim | H05B 45/325 |

* cited by examiner

PIXEL DRIVING CIRCUIT AND DRIVING METHOD IMPROVING STABILITY OF PIXEL DRIVING CIRCUIT IN DRIVING LIGHT EMITTING ELEMENT

The present application claims priority to Chinese Patent Application No. 202010474083.3, titled "PIXEL DRIVING CIRCUIT AND DRIVING METHOD THEREOF, DISPLAY PANEL AND DISPLAY DEVICE", filed on May 29, 2020 with the China National Intellectual Property Administration, which is incorporated herein by reference in its entirety.

FIELD

The present disclosure relates to the field of display technology, and in particular to a pixel driving circuit and a driving method thereof, a display panel and a display device.

BACKGROUND

With the improvement of display technology, requirements on display devices are increasing. In various display technologies, self-luminous display devices have been widely used in various electronic devices including electronic products such as computers and mobile phones due to the advantages such as self-luminous, light and thin, low power consumption, high contrast, high color gamut, and flexible display. In a conventional self-luminous display device, the self-luminous element is generally an organic light emitting diode (OLED), a quantum dot light emitting diode (QLED), a micro light emitting diode (Micro LED), or the like. In practice, the light emitting element is generally driven by a pixel driving circuit to emit light to display a screen. However, the conventional pixel driving circuit has poor stability, which affects the driving effect of the pixel driving circuit on the light emitting element.

SUMMARY

In view of this, a pixel driving circuit and a driving method thereof, a display panel and a display device are provided according to the present disclosure.

The pixel driving circuit includes: a pulse width modulation device, an amplitude modulation device, a first light emitting control device, a second light emitting control device, a drive transistor, and a light emitting element. The pulse width modulation device is configured to output a pulse width setting signal to a first terminal of the first light emitting control device. The pulse width setting signal includes a floating signal and a turn-off signal which are sequentially outputted. The amplitude modulation device is configured to output an amplitude setting signal to a gate of the drive transistor. The drive transistor is configured to output a driving current in response to a signal to the gate of the drive transistor and a signal to a first terminal of the drive transistor. The first light emitting control device is configured to control the pulse width setting signal to be transmitted to the gate of the drive transistor to control light emitting duration of the light emitting element. The second light emitting control device is configured to control, in a case that the first light emitting control device controls the floating signal to be transmitted to the gate of the drive transistor for a first predetermined time period, the driving current to be transmitted to the light emitting element. The light emitting element is configured to emit light based on the driving current.

The driving method is applied to a pixel driving circuit. The pixel driving circuit includes: a pulse width modulation device, an amplitude modulation device, a first light emitting control device, a second light emitting control device, a drive transistor, and a light emitting element. The driving method includes:

during a signal generation period, outputting, by the pulse width modulation device, a floating signal to a first terminal of the first light emitting control device, and outputting, by the amplitude modulation device, an amplitude setting signal to a gate of the drive transistor;

during a control processing period, controlling, by the first light emitting control device, the floating signal to be transmitted to the gate of the drive transistor for a first predetermined time period;

during a light emitting control period, outputting, by the drive transistor, a driving current in response to a signal to the gate of the drive transistor and a signal to a first terminal of the drive transistor, controlling, by the second light emitting control device, the driving current to be transmitted to the light emitting element, and emitting light by the light emitting element based on the driving current; and during a light emitting turn-off period, outputting, by the pulse width modulation device, a turn-off signal to a first terminal of the first light emitting control device, and controlling, by the first light emitting control device, the turn-off signal to be transmitted to the gate of the drive transistor.

The display panel includes a pixel driving circuit. The pixel driving circuit includes: a pulse width modulation device, an amplitude modulation device, a first light emitting control device, a second light emitting control device, a drive transistor, and a light emitting element. The pulse width modulation device is configured to output a pulse width setting signal to a first terminal of the first light emitting control device. The pulse width setting signal includes a floating signal and a turn-off signal which are sequentially outputted. The amplitude modulation device is configured to output an amplitude setting signal to a gate of the drive transistor. The drive transistor is configured to output a driving current in response to a signal to the gate of the drive transistor and a signal to a first terminal of the drive transistor. The first light emitting control device is configured to control the pulse width setting signal to be transmitted to the gate of the drive transistor to control light emitting duration of the light emitting element. The second light emitting control device is configured to control, in a case that the first light emitting control device controls the floating signal to be transmitted to the gate of the drive transistor for a first predetermined time period, the driving current to be transmitted to the light emitting element. The light emitting element is configured to emit light based on the driving current.

The display device includes the above display panel.

According to the present disclosure, a pixel driving circuit and a driving method thereof, a display panel and a display device are provided. The pixel driving circuit includes: a pulse width modulation device, an amplitude modulation device, a first light emitting control device, a second light emitting control device, a drive transistor, and a light emitting element. During the control processing period, the first light emitting control device controls the floating signal to be transmitted to the gate of the drive transistor for the first predetermined time period. Then, during the light emitting control period, the drive transistor outputs a driving current in response to the signal to the gate of the drive transistor and the signal to the first terminal of the drive transistor, the second light emitting control device controls the driving current to be transmitted to the light emitting element, and the light emitting element emits light based on the driving current.

It can be seen that the second light emitting control device according to the present disclosure is configured to control, in a case that the first light emitting control device controls the floating signal to be transmitted to the gate of the drive transistor for the first predetermined time period, the driving current to be transmitted to the light emitting element, and the light emitting element can emit light. In this way, the light emitting element can be driven to emit light after a fluctuation period of voltage of the gate of the drive transistor during which the floating signal is initially inputted to the gate of the drive transistor is passed, improving the stability of the pixel driving circuit in driving the light emitting element, thus ensuring an excellent driving effect of the pixel driving circuit on the light emitting element.

BRIEF DESCRIPTION OF THE DRAWINGS

The drawings to be used in the description of the embodiments are described briefly as follows. It is apparent that the drawings in the following description only illustrate some embodiments of the present disclosure.

DETAILED DESCRIPTION OF THE EMBODIMENTS

Embodiments of the present disclosure are described clearly and completely in conjunction with the drawings hereinafter. It is apparent that the described embodiments are only a few rather than all of the embodiments according to the present disclosure.

As described in the background part, in practice, the light emitting element is generally driven by a pixel driving circuit to emit light to display a screen. However, the conventional pixel driving circuit has poor stability, which affects the driving effect of pixel driving circuit on the light emitting element.

Therefore, a pixel driving circuit and a driving method thereof, a display panel and a display device are provided according to the embodiments of the present disclosure to effectively solve the problems in the conventional technology, and the stability of the pixel driving circuit in driving the light emitting element is improved, ensuring an excellent driving effect of the pixel driving circuit on the light emitting element.

Embodiments are provided according to the present disclosure, which are described in detail with reference to FIG. 1 to FIG. 14.

Figure 1:
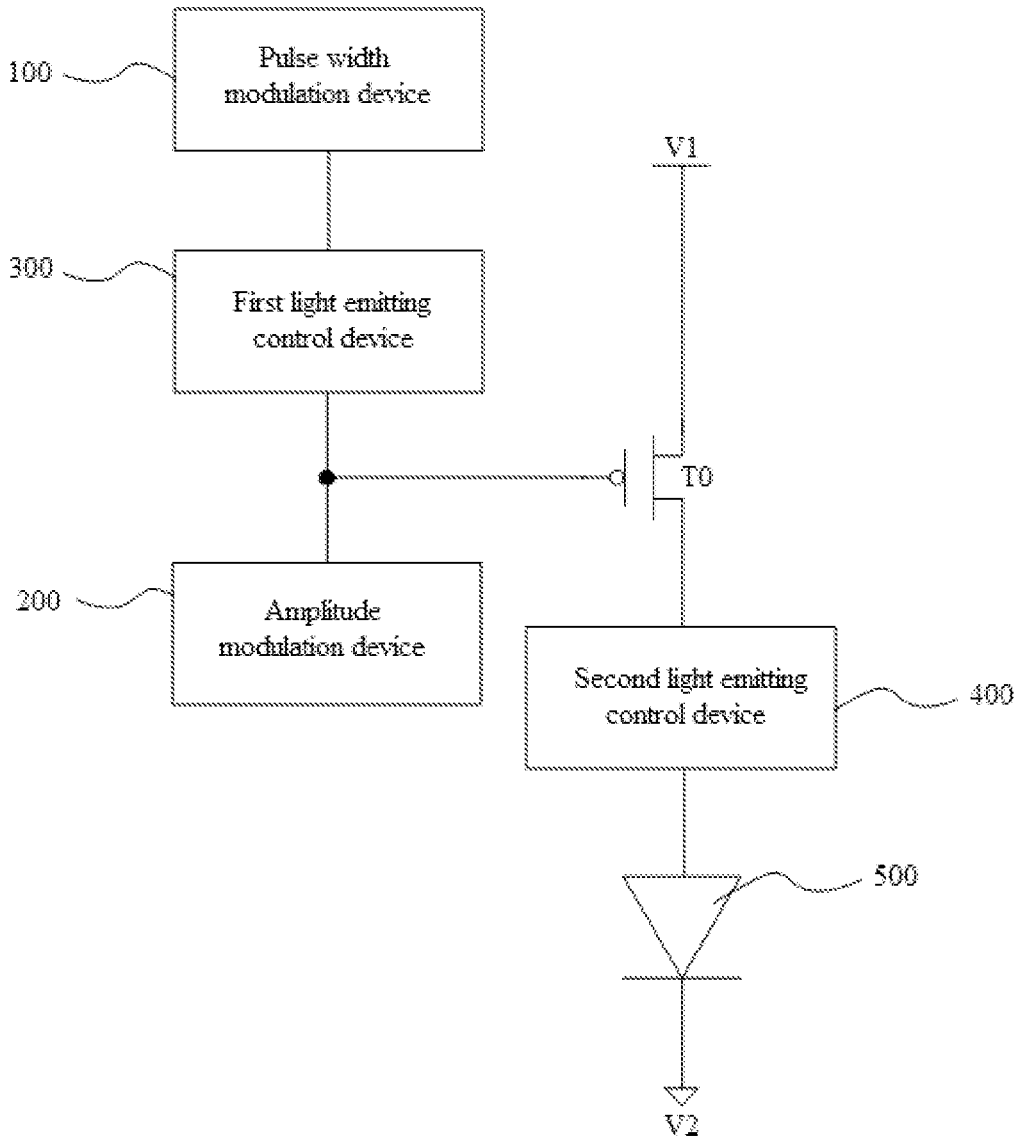
FIG. 1 is a schematic structural diagram of a pixel driving circuit according to an embodiment of the present disclosure.

Reference is made to FIG. 1, which is a schematic structural diagram of a pixel driving circuit according to an embodiment of the present disclosure. The pixel driving circuit includes: a pulse width modulation device 100, an amplitude modulation device 200, a first light emitting control device 300, a second light emitting control device 400, a drive transistor T0, and a light emitting element 500.

The pulse width modulation device 100 is configured to output a pulse width setting signal to a first terminal of the first light emitting control device 300. The pulse width setting signal includes a floating signal and a turn-off signal which are sequentially outputted.

The amplitude modulation device 200 is configured to output an amplitude setting signal to a gate of the drive transistor T0.

The drive transistor T0 is configured to output a driving current in response to a signal to the gate of the drive transistor T0 and a signal to a first terminal of the drive transistor T0.

The first light emitting control device 300 is configured to control the pulse width setting signal to be transmitted to the gate of the drive transistor T0 to control light emitting duration of the light emitting element 500.

The second light emitting control device 400 is configured to control, in a case that the first light emitting control device 300 controls the floating signal to be transmitted to the gate of the drive transistor T0 for a first predetermined time period, the driving current to be transmitted to the light emitting element 500.

The light emitting element 500 is configured to emit light based on the driving current.

Figure 2:
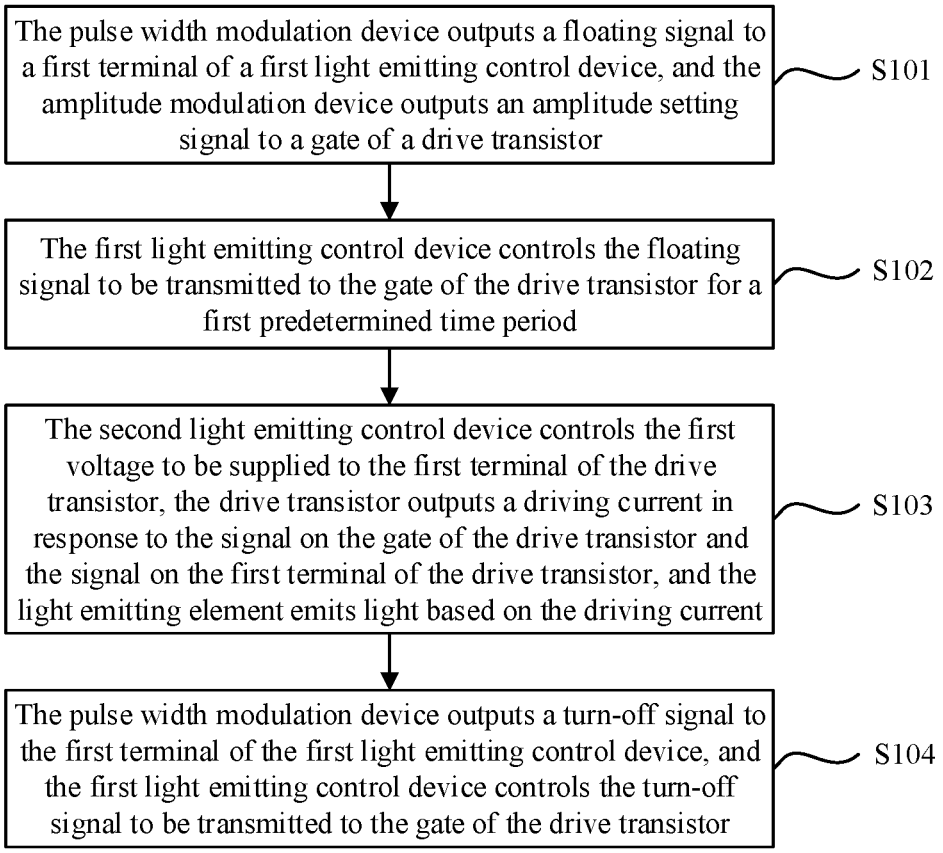
FIG. 2 is a flow chart of a driving method according to an embodiment of the present disclosure.

Reference is made to FIG. 2, which is a flow chart of a driving method according to an embodiment of the present disclosure. The driving method may be applied to the pixel driving circuit shown in FIG. 1. The driving method is performed sequentially in a signal generation period S101, a control processing period S102, a light emitting control period S103, and a light emitting turn-off period S104.

During the signal generation period S101, the pulse width modulation device 100 outputs the floating signal to the first terminal of the first light emitting control device 300, and the amplitude modulation device 200 outputs the amplitude setting signal to the gate of the drive transistor T0.

During the control processing period S102, the first light emitting control device 300 controls the floating signal to be transmitted to the gate of the drive transistor T0 for the first predetermined time period.

During the light emitting control period S103, the drive transistor T0 outputs a driving current in response to the signal to the gate of the drive transistor T0 and the signal to the first terminal of the drive transistor T0, the second light emitting control device 400 controls the driving current to be transmitted to the light emitting element 500, and the light emitting element 500 emits light based on the driving current.

During the light emitting turn-off period S104, the pulse width modulation device 100 outputs the turn-off signal to the first terminal of the first light emitting control device 300, and the first light emitting control device 300 controls the turn-off signal to be transmitted to the gate of the drive transistor T0.

It can be seen that the second light emitting control device 400 according to the embodiment of the present disclosure is configured to control, in a case that the first light emitting control device 300 controls the floating signal to be transmitted to the gate of the drive transistor T0 for the first predetermined time period, the driving current to be transmitted to the light emitting element 500, and the light emitting element 500 can emit light. In this way, the light emitting element 500 can be driven to emit light after a fluctuation period of a voltage of the gate of the drive transistor during which the floating signal is initially inputted to the gate of the drive transistor T0 is passed, improving the stability of the pixel driving circuit in driving the light emitting element, thus ensuring an excellent driving effect of the pixel driving circuit on the light emitting element.

It should be understood that, the drive transistor T0 according to the embodiments of the present disclosure is configured to output a driving current in response to the signal to the gate of the drive transistor T0 and the signal to the first terminal of the drive transistor T0. When the drive transistor T0 generates the driving current, the voltage of the gate of the drive transistor T0 is determined by the amplitude setting signal and the floating signal. Since the floating signal indicates a high-impedance state, the driving current may be determined depending on the amplitude setting signal, to determine the light emitting brightness of the light-emitting element 500. In addition, according to the present disclosure, when the turn-off signal is transmitted to the gate of the drive transistor T0, the drive transistor T0 is controlled to stop generating the driving current, and the light emitting element 500 stops emitting light. Therefore, in a case that the duration of the pulse width setting signal is constant, the light emitting duration of the light emitting element 500 can be controlled by setting proportions of the floating signal and the turn-off signal.

In an embodiment of the present disclosure, the first predetermined time period is greater than or equal to 0.5 microseconds. It is found that when the first light emitting control device 300 is turned on, the voltage of the gate of the drive transistor T0 fluctuates for less than 0.5 microseconds. Therefore, in a case that the first light emitting control device 300 controls the floating signal to be transmitted to the gate of the drive transistor T0 for a time period of not less than 0.5 microseconds, the second light emitting control device is turned on and controls the driving current to be transmitted to the light emitting element 500, and the light emitting element 500 can emit light. In this way, the light emitting element 500 can be driven to emit light after the fluctuation period of the voltage of the gate of the drive transistor during which the floating signal is initially inputted to the gate of the drive transistor T0 is passed, improving the stability of the pixel driving circuit in driving the light emitting element, thus ensuring an excellent driving effect of the pixel driving circuit on the light emitting element.

It should be noted that the upper limit of the first predetermined time period is not limited according to the embodiments of the present disclosure, which is determined by analyzing parameters such as the type of display device, the detail structure of the pixel driving circuit, and the type of transistors in the pixel driving circuit.

Figure 3:
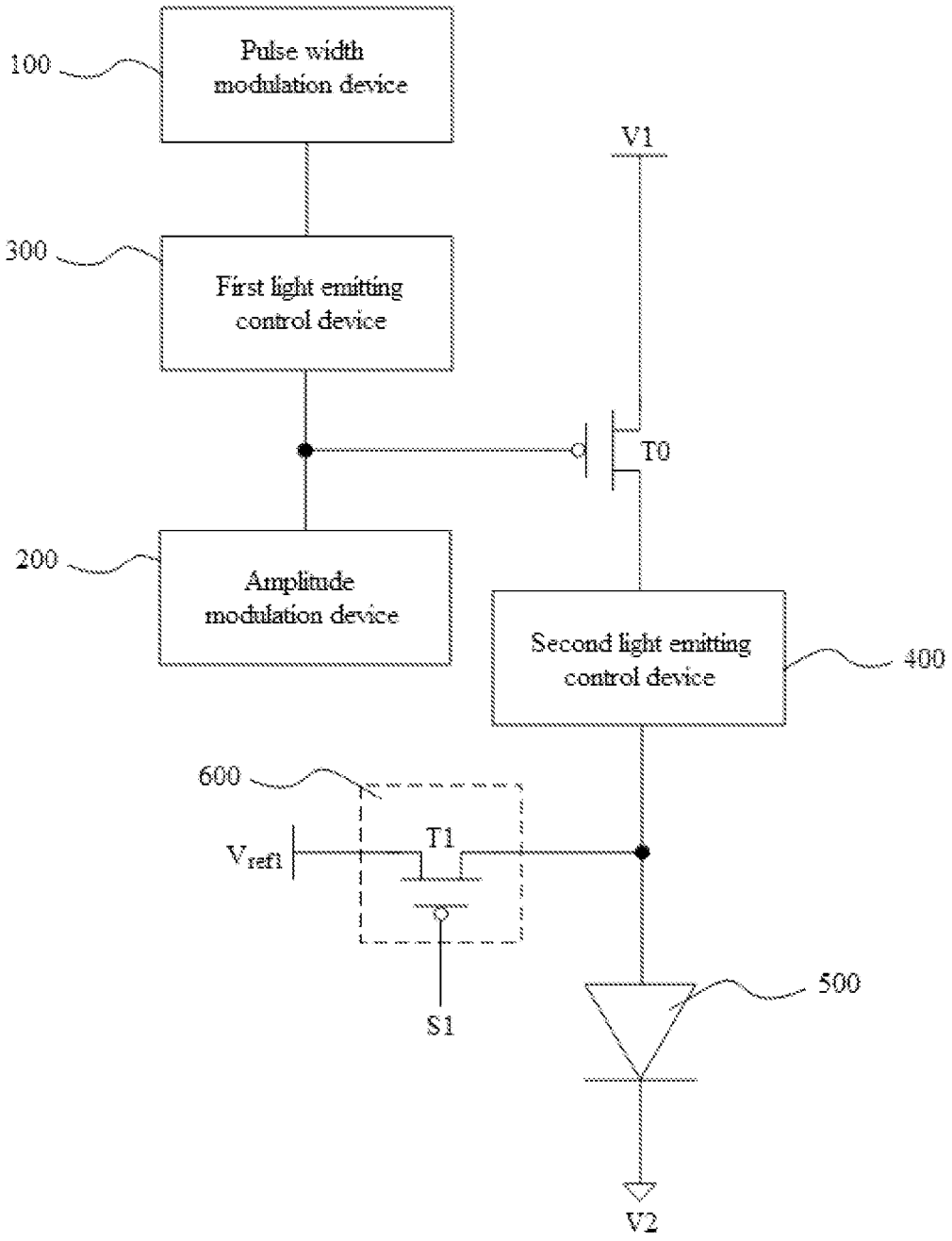
FIG. 3 is a schematic structural diagram of a pixel driving circuit according to another embodiment of the present disclosure.

Reference is made to FIG. 3, which is a schematic structural diagram of a pixel driving circuit according to another embodiment of the present disclosure. Based on the pixel driving circuit shown in FIG. 1, the pixel driving circuit shown in FIG. 3 further includes a delay control device 600. The delay control device 600 is electrically connected to a first electrode of the light emitting element 500. The delay control device 600 is configured to transmit, in response to a first control signal S1, a first reference voltage $V_{ref1}$ to a first electrode of the light emitting element 500 within a second predetermined time period from a time when the second light emitting control device 400 controls the driving current to be transmitted to the first electrode of the light emitting element 500.

Figure 4:
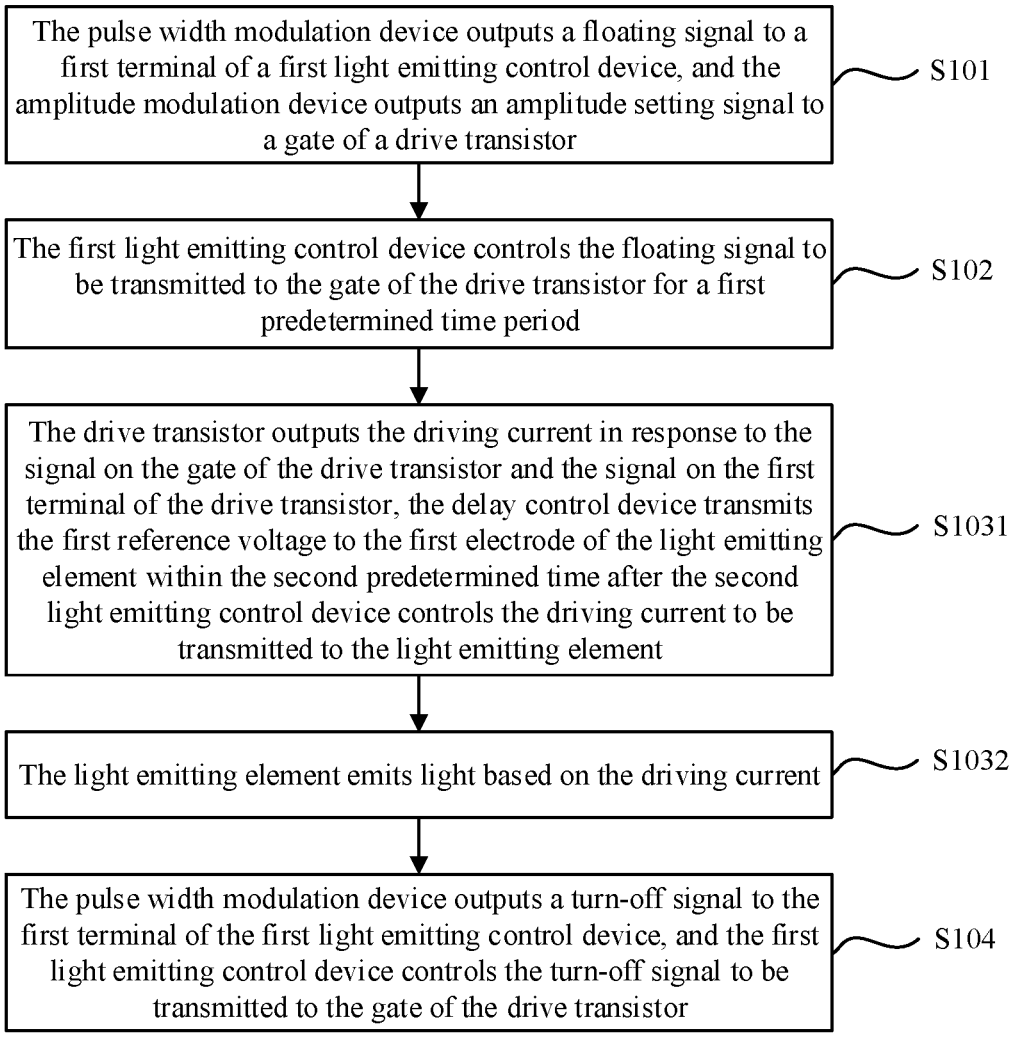
FIG. 4 is a flow chart of a driving method according to another embodiment of the present disclosure.

Reference is made to FIG. 4, which is a flow chart of a driving method according to another embodiment of the present disclosure. The driving method may be applied to the pixel driving circuit shown in FIG. 3. That is, in a case that the pixel driving circuit further includes the delay control device 600, the driving method is performed sequentially in a signal generation period S101, a control processing period S102, and a light emitting control period. The light emitting control period sequentially includes a delay light emitting sub-period S1031 and a light emitting sub-period S1032.

During the signal generation period S101, the pulse width modulation device 100 outputs the floating signal to the first terminal of the first light emitting control device 300, and the amplitude modulation device 200 outputs the amplitude setting signal to the gate of the drive transistor T0.

During the control processing period S102, the first light emitting control device 300 controls the floating signal to be transmitted to the gate of the drive transistor T0 for the first predetermined time period.

During the delay light emitting sub-period S1031, the drive transistor T0 outputs the driving current in response to the signal to the gate of the drive transistor T0 and the signal to the first terminal of the drive transistor T0, the delay control device 600 transmits the first reference voltage $V_{ref1}$ to the first electrode of the light emitting element 500 within the second predetermined time period from a time when the second light emitting control device 400 controls the driving current to be transmitted to the light emitting element 500.

During the light emitting sub-period S1032, the light emitting element 500 emits light based on the driving current.

As shown in FIG. 3, the delay control device 600 according to an embodiment of the present disclosure includes: a first transistor Ti. The first reference voltage $V_{ref1}$ is supplied to a first terminal of the first transistor Ti, a second terminal of the first transistor T1 is electrically connected to the first electrode of the light emitting element 500, and the first control signal Si is inputted to a gate of the first transistor Ti. The first transistor T1 may be a P-type transistor. In this case, the first transistor T1 is turned on in response to a low-level signal in the first control signal S1 and transmits the first reference voltage $V_{ref1}$ to the first electrode of the light emitting element 500. Alternatively, the first transistor T1 may be an N-type transistor. In this case, the first transistor T1 is turned on in response to a high-level signal in the first control signal Si and transmits the first reference voltage $V_{ref1}$ to the first electrode of the light emitting element 500. The conduction type of the first transistor T1 is not limited in the present disclosure.

It should be understood that in the pixel driving circuit shown in FIG. 3, in a case that the first light emitting control device 300 controls the floating signal to be transmitted to the gate of the drive transistor T0 for the first predetermined time period, the first reference voltage $V_{ref1}$ is transmitted to the first electrode of the light emitting element 500 within the second predetermined time period from a time when the second light emitting control device 400 controls the driving current to be transmitted to the light emitting element 500. The driving current may be controlled depending on the first reference voltage $V_{ref1}$, and the light emitting element 500 maintains in an off state. Therefore, in a case of a sum of the first predetermined time period and the second predetermined time period elapses, the light emitting element 500 is turned on to emit light, so that the light emitting element 500 can be driven to emit light after a fluctuation period of the voltage of the gate of the drive transistor during which the floating signal is initially inputted to the gate of the drive transistor T0 is passed, improving the stability of the pixel driving circuit in driving the light emitting element, thus ensuring an excellent driving effect of the pixel driving circuit on the light emitting element.

In an embodiment of the present disclosure, the delay control device 600 may transmit the first reference voltage $V_{ref1}$ to the first electrode of the light emitting element 500 during at least one of the signal generation period S101 and the control processing period S102 to reset the voltage of the first electrode of the light emitting element 500, avoiding the light emitting element 500 from emitting light under the control of a voltage remaining in the circuit, ensuring a high stability of the display device in a dark state, thus avoiding a problem of light leakage of the display device in the dark state.

In an embodiment of the present disclosure, in a case the pixel driving circuit includes a delay control device 600, the first predetermined time period and the second predetermined time period are both greater than 0, and a sum of the first predetermined time period and the second predetermined time period is greater than or equal to 0.5 microseconds. It is found that when the first light emitting control device 300 is turned on, the voltage of the gate of the drive transistor T0 may fluctuate for less than 0.5 microseconds. Therefore, in a case that the first predetermined time period and the second predetermined time period elapse, the light emitting element 500 is controlled to emit light, so that the light emitting element 500 can be driven to emit light after a fluctuation period of the voltage of the gate of the drive transistor during which the floating signal is initially inputted to the gate of the drive transistor T0 is passed, improving the stability of the pixel driving circuit in driving the light emitting element, thus ensuring an excellent driving effect of the pixel driving circuit on the light emitting element.

It should be noted that, according to the embodiments of the present disclosure, the upper limit of the sum of the first predetermined time period and the second predetermined time period, and the proportions of the first predetermined time period and the second predetermined time period in the sum are not limited, which are determined by analyzing parameters such as the type of display device, the detail structure of the pixel driving circuit, and the type of transistors in the pixel driving circuit.

Detail structure of each device in the pixel driving circuit and a driving method according to the embodiments of the present disclosure are described in conjunction with the drawings hereinafter.

Figure 5:
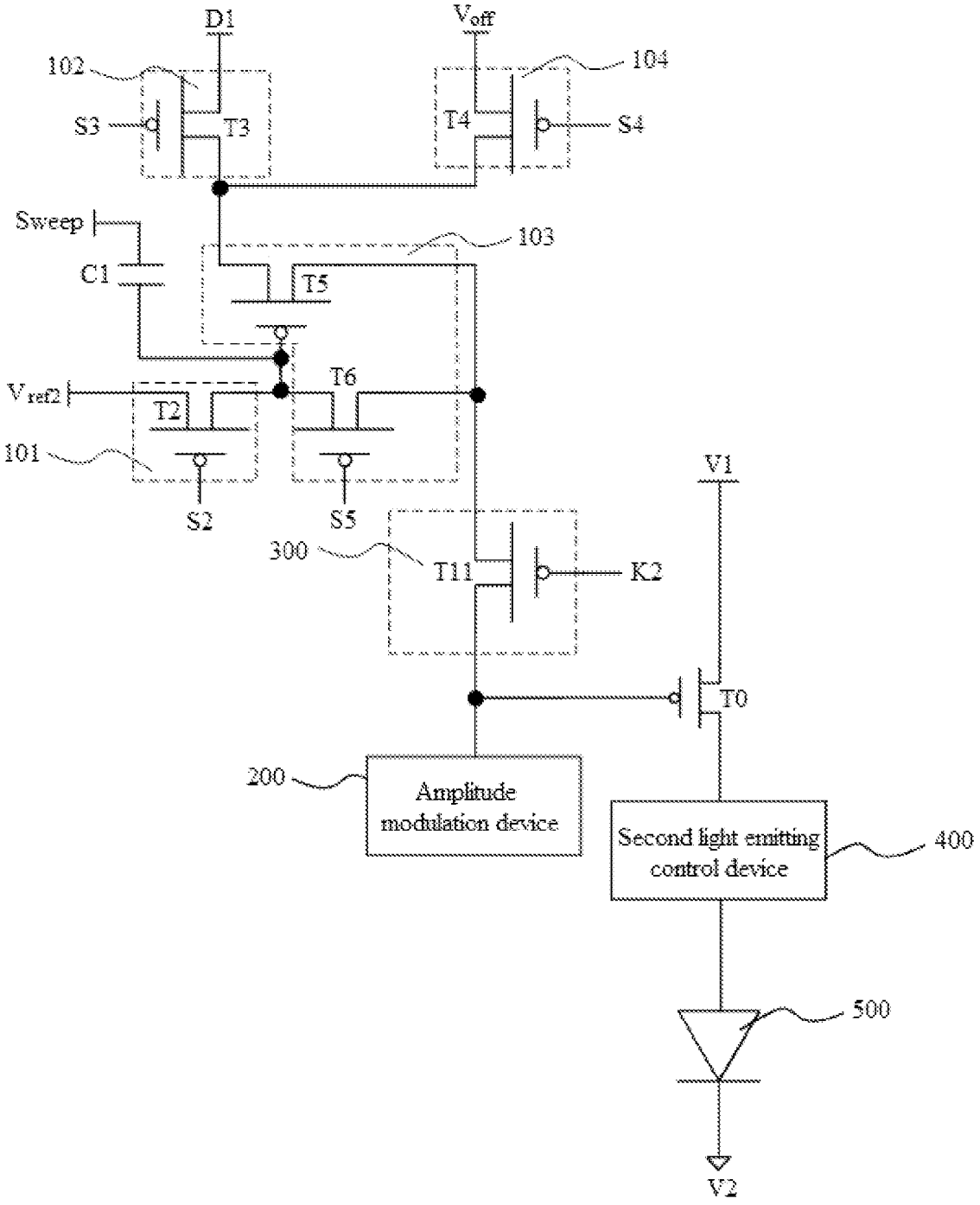
FIG. 5 is a schematic structural diagram of a pulse width modulation device according to an embodiment of the present disclosure.

Reference is made to FIG. 5, which is a schematic structural diagram of a pulse width modulation device according to an embodiment of the present disclosure. According to the embodiment of the present disclosure, the pulse width modulation device includes: a first reset device 101, a first data writing device 102, a first capacitor C1, a generation device 103, and a turn-off device 104.

The first reset device 101 is configured to transmit a second reference voltage $V_{ref2}$ to a first control terminal of the generation device 103 in response to a second control signal S2. A first electrode plate of the first capacitor C1 is supplied with a pulse width control voltage Sweep, and a second electrode plate of the first capacitor C1 is electrically connected to the first control terminal of the generation device 103.

The first data writing device 102 is configured to transmit a first data voltage D1 to an input terminal of the generation device 103 in response to a third control signal S3.

The turn-off device 104 is configured to transmit a turn-off signal $V_{off}$ to the input terminal of the generation device 103 in response to a fourth control signal S4. The turn-off signal $V_{off}$ is used for turning off the drive transistor T0 to turn the drive transistor into an off state.

The generation device 103 is configured to sequentially output the floating signal and the turn-off signal $V_{off}$ based on the first data voltage D1 and a voltage of the second electrode plate of the first capacitor C1 and in response to a fifth control signal S5 inputted to a second control terminal of the generation device 103.

As shown in FIG. 5, the first reset device 101 according to the embodiment of the present disclosure includes a second transistor T2. The second reference voltage $V_{ref2}$ is supplied to a first terminal of the second transistor T2. A second terminal of the second transistor T2 is electrically connected to the first control terminal of the generating device 103. The second control signal S2 is inputted to a gate of the second transistor T2.

The first data writing device 102 includes a third transistor T3. The first data voltage D1 is supplied to a first terminal of the third transistor T3. A second terminal of the third transistor T3 is electrically connected to the input terminal of the generation device 103. The third control signal S3 is inputted to a gate of the third transistor T3.

The turn-off device 104 includes a fourth transistor T4. The turn-off signal $V_{off}$ is inputted to a first terminal of the fourth transistor T4. A second terminal of the fourth transistor T4 is electrically connected to the input terminal of the generation device 103. The fourth control signal S4 is inputted to a gate of the fourth transistor T4.

The generation device 103 includes a fifth transistor T5 and a sixth transistor T6. A first terminal of the fifth transistor T5 serves as the input terminal of the generation device 103. A second terminal of the fifth transistor T5 and a second terminal of the sixth transistor T6 are electrically connected together to serve as an output terminal of the generation device 103. A gate of the fifth transistor T5 and a first terminal of the sixth transistor T6 are electrically connected together to serve as the first control terminal of the generation device 103. A gate of the sixth transistor T6 serves as the second control terminal of the generation device 103.

It should be understood that the pulse width modulation device 100 according to the embodiment of the present disclosure is configured to output the floating signal during the signal generation period S101, the control processing period S102, and the light emitting control period S103, and to output the turn-off signal $V_{off}$ during the light emitting turn-off period S104. In a case that the pulse width modulation device 100 has a structure shown in FIG. 5, the signal generation period S101 sequentially includes a first sub-period and a second sub-period. During the first sub-period, the second transistor T2 in the first reset device 101 is turned on to transmit the second reference voltage $V_{ref2}$ to the gate of the fifth transistor T5 in the generation device 103. The second reference voltage $V_{ref2}$ is used for controlling the fifth transistor T5 to be turned on. In this case, the third transistor T3 in the first data writing device 102, the fourth transistor T4 in the turn-off device 104, and the sixth transistor T6 in the generation device 103 are all in the off state. During the second sub-period, the second transistor T2 in the first reset device 101 is turned off, and the third transistor T3 in the first data writing device 102 and the sixth transistor T6 in the generation device 103 are turned on in response to respective control signals. The first data voltage D1 is transmitted to the gate of the fifth transistor T5 via the third transistor T3, the fifth transistor T5, and the sixth transistor T6 until the voltage at the gate of the fifth transistor T5 cannot control the fifth transistor T5 to be turned on, and the fifth transistor T5 is turned off. In this case, the fourth transistor T4 remains in the off state. Then, the third transistor T3, the fifth transistor T5, and the sixth transistor T6 are turned off, so that the output terminal of the generation device 103 is in a floating state, that is, the pulse width modulation device 100 outputs a floating signal to the first terminal of the first light emitting control device 300.

Since the fourth capacitor C1 has a storage performance and the pulse width control voltage Sweep is set as a linearly varying voltage, the pulse width control voltage Sweep is controlled to vary following a linear voltage to control the voltage of the second electrode plate of the first capacitor C1, so that the voltage of the second electrode plate of the first capacitor C1 is controlled to maintain the fifth transistor T5 in the off state during the control processing period S102 and the light emitting control period S103. The fourth transistor T4 may be turned on at any time during the control processing period S102 and the control light emitting period S103 in response to the fourth control signal S4. In a case that the voltage of the second electrode plate of the fourth capacitor C1 is controlled to turn on the fifth transistor T5, the method proceeds to the light emitting turn-off period S104, during which the turn-off signal $V_{off}$ is transmitted to the first terminal of the first light emitting control device 300 via the fourth transistor T4 and the fifth transistor T5, and is transmitted to the gate of the drive transistor T0 from the first light emitting control device 300 to control the drive transistor T0 to be turned off to stop outputting the driving current, and the light emitting element 500 is turned off. Therefore, the duration of the floating signal is determined by the pulse width control voltage Sweep and the first data voltage D1, and the light emitting duration of the light emitting element 500 can be adjusted by adjusting the pulse width control voltage Sweep and the first data voltage D1.

In an embodiment of the present disclosure, the conduction types of the second transistor T2, the third transistor T3, the fourth transistor T4, the fifth transistor T5, and the sixth transistor T6 are not limited according to the present disclosure, which may be P-type transistors or N-type transistors, as long as there transistors can be used to realize the operation process of the pulse width modulation device 100 in response to the received control signals. In a case that the fifth transistor T5 is a P-type transistor, the pulse width control voltage Sweep is a linear falling voltage; and in a case that the fifth transistor T5 is an N-type transistor, the pulse width control voltage Sweep is a linearly rising voltage.

In an embodiment of the present disclosure, in a case that the third transistor T3 and the sixth transistor T6 have the same conduction type, the third control signal S3 and the fifth control signal S5 are identical to each other, and are outputted from the same signal terminal, reducing the number of signal terminals in the pixel driving circuit, thus simplifying the wiring of the pixel driving circuit.

Figure 6:
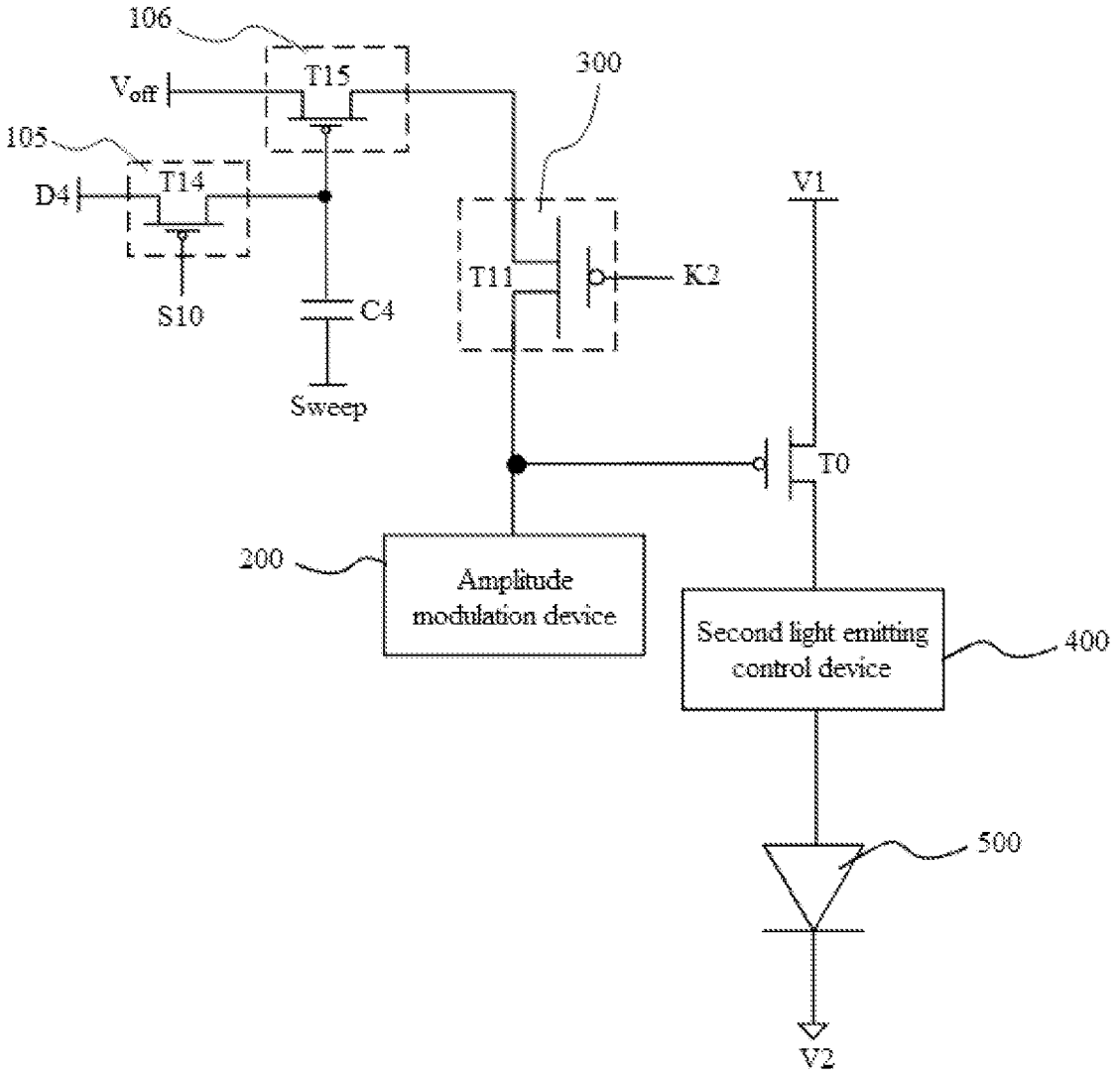
FIG. 6 is a schematic structural diagram of a pulse width modulation device according to another embodiment of the present disclosure.

The structure shown in FIG. 5 is only one of the structures of the pulse width modulation device to which the present disclosure is applied, and the pulse width modulation device may have other structures. Reference is made to FIG. 6, which is a schematic structural diagram of a pulse width modulation device according to another embodiment of the present disclosure. According to this embodiment of the present disclosure, the pulse width modulation device includes: a third data writing device 105, a switch device 106, and a fourth capacitor C4. The third data writing device 105 is configured to transmit a fourth data voltage D4 to a control terminal of the switch device 106 in response to a tenth control signal S10. The pulse width control voltage Sweep is supplied to a first electrode plate of the fourth capacitor C4, and a second electrode plate of the fourth capacitor C4 is electrically connected to the control terminal of the switch device 106. The switch device 106 is configured to output a floating signal and then output a turn-off signal $V_{off}$ which is inputted to an input terminal of the switch device 106 based on a voltage of the second electrode plate of the fourth capacitor C4.

As shown in FIG. 6, the third data writing device 105 according to the embodiment includes a fourteenth transistor T14. The tenth control signal S10 is inputted to a gate of the fourteenth transistor T14, the fourth data voltage D4 is supplied to a first terminal of the fourteenth transistor T14, and a second terminal of the fourteenth transistor T14 is electrically connected to the control terminal of the switch device 106. The switch device 106 includes a fifteenth transistor T15. A gate of the fifteenth transistor T15 serves as the control terminal of the switch device 106. A first terminal of the fifteenth transistor T15 serves as the input terminal of the switch device 106 and is supplied with the turn-off signal $V_{off}$. A second terminal of the fifteenth transistor T15 serves as an output terminal of the switch device 106 and is electrically connected to the first terminal of the first light emitting control device 300.

It should be understood that the pulse width modulation device 100 according to the embodiment of the present disclosure is configured to output the floating signal during the signal generation period S101, the control processing period S102, and the light emitting control period S103, and to output the turn-off signal $V_{off}$ during the light emitting turn-off period S104. In a case that the pulse width modulation device 100 has a structure shown in FIG. 6, the signal generation period S101 sequentially includes a first sub-period and a second sub-period. During the first sub-period, the third data device 105 controls, in response to the tenth control signal S10, the fourteenth transistor T14 to be turned on to transmit the fourth data voltage D4 to the control terminal of the switch device 106. During the second sub-period, the fourteenth transistor T14 is controlled to be in an off state, the voltage of the second electrode plate of the fourth capacitor C4 is adjusted based on the pulse width control voltage Sweep and the fourth data voltage D4, so that the fifteenth transistor T15 in the control switch device 106 is controlled to be in an off state, thus the output terminal of the control switch device 106 (that is, a second terminal of the fifteenth transistor T15) is in a floating state, that is, the pulse width modulation device 100 outputs a floating signal to the first terminal of the first light emitting control device 300.

Since the fourth capacitor C4 has a storage performance and the pulse width control voltage Sweep is set as a linearly varying voltage, the pulse width control voltage Sweep is controlled to vary following a linear voltage to control the voltage of the second electrode plate of the fourth capacitor C4, so that the voltage of the second electrode plate of the fourth capacitor C4 is controlled to maintain the fifteenth transistor T15 in the off state during the control processing period S102 and the light emitting control period S103. In a case that the voltage of the second electrode plate of the fourth capacitor C4 is controlled to turn on the fifteenth transistor T15, the method proceeds to the light emitting turn-off period S104, during which the turn-off signal $V_{off}$ is transmitted to the first terminal of the first light emitting control device 300 via the fifteenth transistor T15, and is transmitted to the gate of the drive transistor T0 from the first light emitting control device 300 to control the drive transistor T0 to be turned off to stop outputting the driving current, and the light emitting element 500 is turned off. Therefore, the duration of the floating signal is determined by the pulse width control voltage Sweep and the fourth data voltage D4, and the light emitting duration of the light emitting element 500 may be adjusted by adjusting the pulse width control voltage Sweep and the fourth data voltage D4.

In an embodiment of the present disclosure, the conduction types of the fourteenth transistor T14 and the fifteenth transistor T15 are not limited according to the present disclosure, which may be P-type transistors or N-type transistors, as long as these transistors can be used to realize the operation process of the pulse width modulation device 100 in response to the received control signals. In a case that the fifteenth transistor T15 is a P-type transistor, the pulse width control voltage Sweep is a linear falling voltage; and in a case that the fifteenth transistor T15 is an N-type transistor, the pulse width control voltage Sweep is a linearly rising voltage.

It should be noted that the pulse width modulation device 100 according to the embodiments of the present disclosure may have other structures in addition to the structures shown in FIG. 5 and FIG. 6, which is not limited in the present disclosure.

Figure 7:
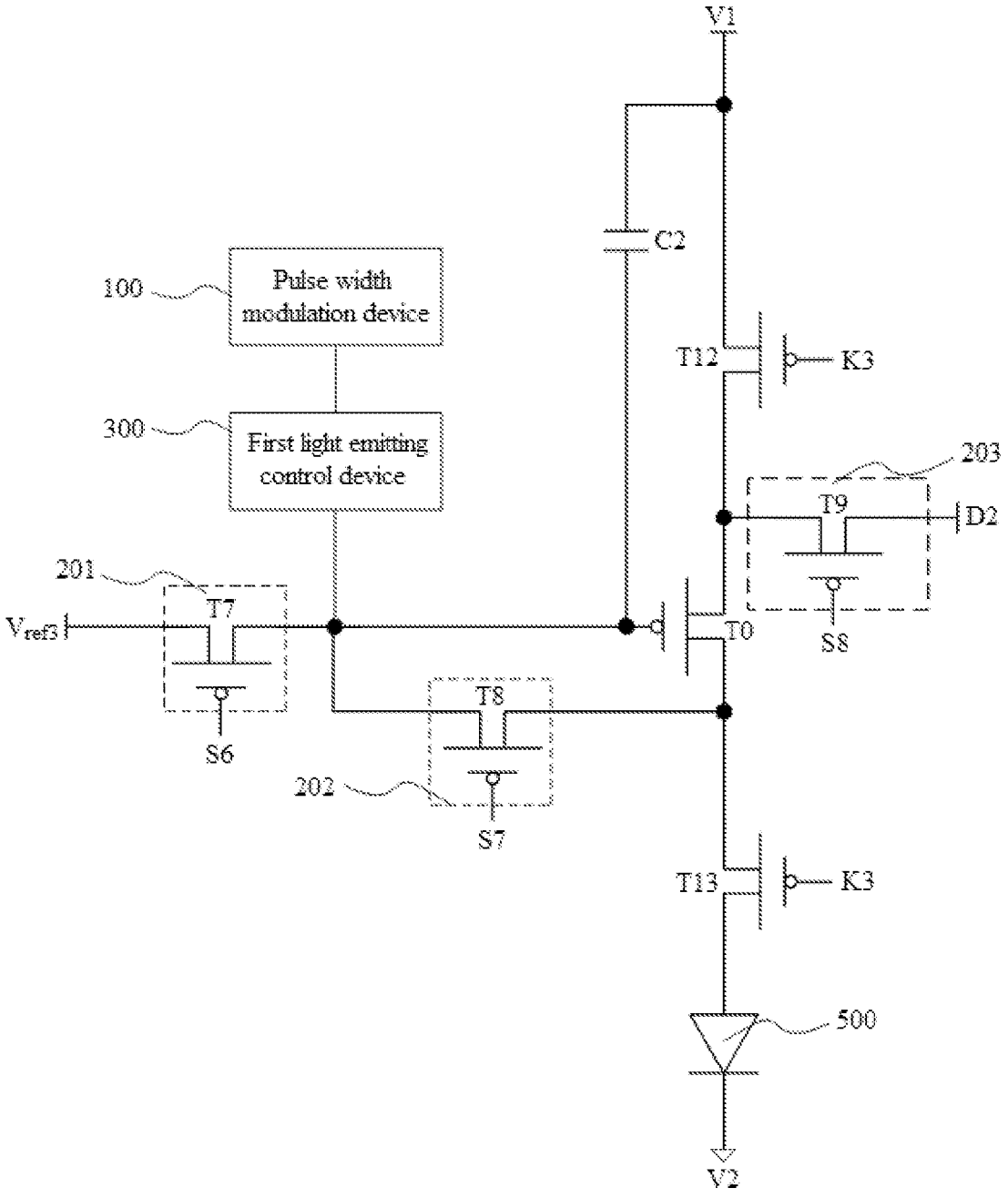
FIG. 7 is a schematic structural diagram of an amplitude modulation device according to an embodiment of the present disclosure.

Reference is made to FIG. 7, which is a schematic structural diagram of an amplitude modulation device according to an embodiment of the present disclosure. According to the embodiment of the present disclosure, the amplitude modulation device includes: a second reset device 201, a second capacitor C2, a connection device 202, and a second data writing device 203.

The second reset device 201 is configured to transmit a third reference voltage $V_{ref3}$ to the gate of the drive transistor T0 in response to a sixth control signal S6. A first electrode plate of the second capacitor C2 is supplied with a first voltage V1, and a second electrode plate of the second capacitor C2 is electrically connected to the gate of the drive transistor T0.

The connection device 202 is configured to electrically connect the gate of the drive transistor T0 and a second terminal of the drive transistor T0 in response to a seventh control signal S7.

The second data writing device 203 is configured to transmit a second data voltage D2 to the first terminal of the drive transistor T0 in response to an eighth control signal S8.

As shown in FIG. 7, the second reset device 201 includes a seventh transistor T7. The third reference voltage $V_{ref3}$ is supplied to a first terminal of the seventh transistor T7, and a second terminal of the seventh transistor T7 is electrically connected to the gate of the drive transistor T0, and the sixth control signal S6 is inputted to a gate of the seventh transistor T7.

The connection device 202 includes an eighth transistor T8. A first terminal of the eighth transistor T8 is electrically connected to the gate of the drive transistor T0, a second terminal of the eighth transistor T8 is electrically connected to the second terminal of the drive transistor T0. The seventh control signal S7 is inputted to the gate of the drive transistor T0.

The second data writing device 203 includes a ninth transistor T9. The second data voltage D2 is supplied to a first terminal of the ninth transistor T9, the second terminal of the ninth transistor T9 is electrically connected to the first terminal of the drive transistor T0, and the eighth control signal S8 is inputted to a gate of the ninth transistor T9.

It should be understood that the amplitude modulation device 200 according to the embodiment of the present disclosure is configured to output an amplitude setting signal to the gate of the drive transistor T0 during the signal generation period S101, the control processing period S102, and the light emitting control period S103. In a case that the amplitude modulation device 200 has a structure shown in FIG. 7, the signal generation period S101 includes a first sub-period and a second sub-period. During the first sub-period, the second reset device 201 turns on the seventh transistor T7 in response to the sixth control signal S6 to transmit the third reference voltage $V_{ref3}$ to the gate of the drive transistor T0 for resetting. The third reference voltage $V_{ref3}$ is used for controlling the drive transistor T0 to be turned on. In this case, both the eighth transistor T8 and the ninth transistor T9 are controlled to be in the off state. During the second sub-period, the connection device 202 turns on the eighth transistor T8 in response to the seventh control signal S7, the second data writing device 203 turns on the ninth transistor T9 in response to the eighth control signal S8 to transmit the second data voltage D2 to the first terminal of the drive transistor T0, and the drive transistor T0 is controlled to be turned on due to the storage performance of the second capacitor C2. In this way, a path from the second data voltage D2 to the gate of the drive transistor T0 is formed, so that the voltage of the second electrode plate of the second capacitor C2 changes until the drive transistor T0 is controlled to switch from the on state to the off state. Thus, the second data voltage D2 is written and the voltage of the second electrode plate of the second capacitor C2 is equal to a voltage of the amplitude setting signal.

Since the second capacitor C2 has the storage performance, the voltage of the second electrode plate of the second capacitor C2 is maintained at the voltage of the amplitude setting signal during the control processing period S102 and the light emitting control period S103 until the turn-off signal $V_{off}$ is transmitted to the gate of the drive transistor T0 during the light emitting turn-off period S104.

In an embodiment of the present disclosure, the conduction types of the seventh transistor T7, the eighth transistor T8, and the ninth transistor T9 are not limited according to the present disclosure, which may be P-type transistors or N-type transistors, as long as there transistors can be used to realize the operation process of the amplitude modulation device 200 in response to the received control signals. In a case that the eighth transistor T8 and the ninth transistor T9 have the same conduction type, the seventh control signal S7 and the eighth control signal S8 are identical to each other, and the seventh control signal S7 and the eighth control signal S8 are outputted from the same signal terminal, reducing the number of signal terminals in the pixel driving circuit, thus simplifying the wiring of the pixel driving circuit.

Figure 8:
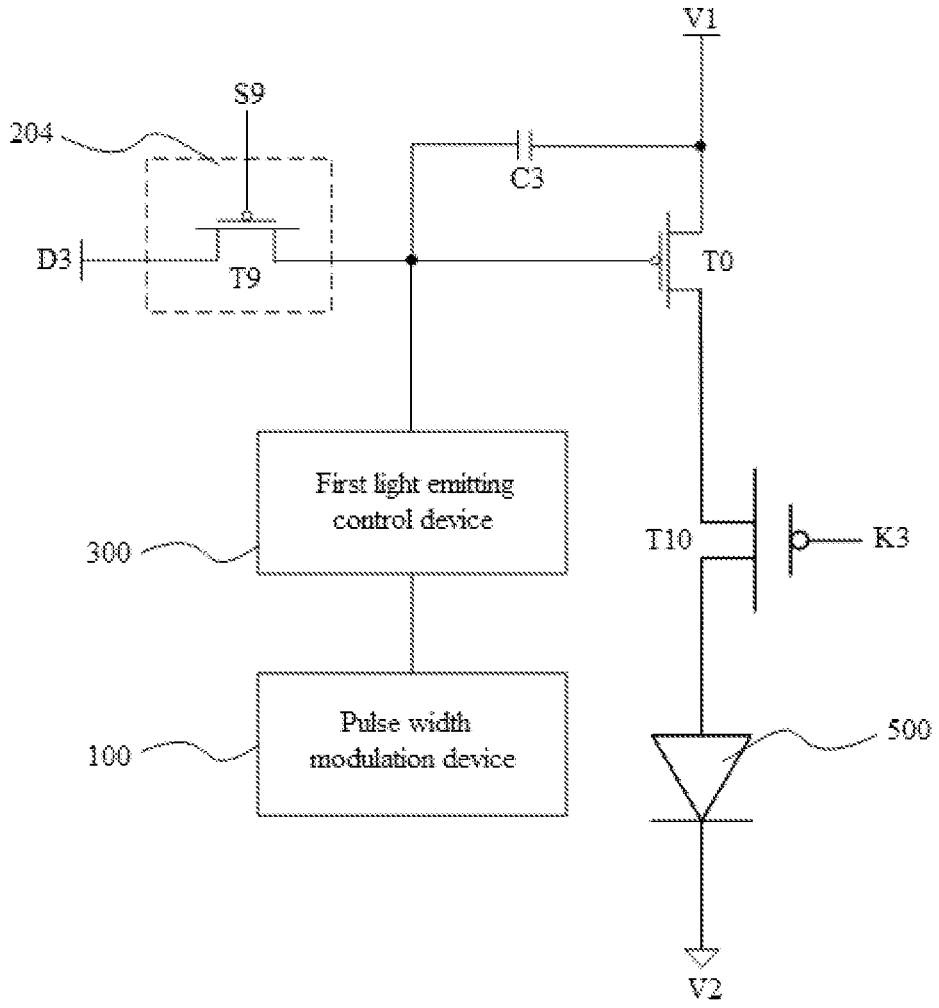
FIG. 8 is a schematic structural diagram of an amplitude modulation device according to another embodiment of the present disclosure.

The structure shown in FIG. 7 is only one of the structures of the amplitude modulation device to which the present disclosure is applied, and the amplitude modulation device may have other structures. Reference is made to FIG. 8, which is a schematic structural diagram of an amplitude modulation device according to another embodiment of the present disclosure. According to the embodiment of the present disclosure, the amplitude modulation device includes: a third capacitor C3 and a third data writing device 204.

A first electrode plate of the third capacitor C3 is supplied with a first voltage V1, and a second electrode plate of the third capacitor C3 is electrically connected to the gate of the drive transistor T0.

The third data writing device 204 is configured to transmit a third data voltage V3 to the gate of the drive transistor T0 in response to a ninth control signal S9.

As shown in FIG. 8, the third data writing device 204 includes a ninth transistor T9. The ninth control signal S9 is inputted to a gate of the ninth transistor T9, the third data voltage D3 is supplied to a first terminal of the ninth transistor T9, and a second terminal of the ninth transistor T9 is electrically connected to the gate of the drive transistor T0.

It should be understood that the amplitude modulation device 200 according to the embodiment of the present disclosure is configured to output an amplitude setting signal to the gate of the drive transistor T0 during the signal generation period S101, the control processing period S102, and the light emitting control period S103. In a case that the amplitude modulation device 200 has a structure shown in FIG. 8, the signal generation period S101 sequentially includes a first sub-period and a second sub-period. During the first sub-period, the third data writing device 204 turns on the ninth transistor T9 in response to the ninth control signal S9 to transmit the third data voltage D3 to the gate of the drive transistor T0. That is, the voltage of the second electrode plate of the third capacitor C3 is equal to a voltage of the amplitude setting signal. During the second sub-period, the ninth transistor T9 is controlled to be in an off state. Then, due to the storage performance of the third capacitor C3, the voltage of the second electrode plate of the third capacitor C3 is maintained at the voltage of the amplitude setting signal during the control processing period S102 and the light emitting control period S103 until the turn-off signal $V_{off}$ is transmitted to the gate of the drive transistor T0 during the light emitting turn-off period S104.

In an embodiment of the present disclosure, the conduction type of the ninth transistor T9 is not limited according to the present disclosure, which may be a P-type transistor or an N-type transistor, as long as the transistor can be used to realize the operation process of the amplitude modulation device 200 in response to the received control signal.

It should be noted that the amplitude modulation device 200 according to the embodiments of the present disclosure may have other structures in addition to the structures shown in FIG. 7 and FIG. 8, which is not limited in the present disclosure.

As shown in FIG. 5 and FIG. 6, in any one of the above embodiments of the present disclosure, the first light emitting control device 300 includes an eleventh transistor T11. The pulse width setting signal is inputted to a first terminal of the eleventh transistor T11, a second terminal of the eleventh transistor T11 is electrically connected to the gate of the drive transistor T0, and a second light emitting control signal K2 is inputted to a gate of the eleventh transistor T11.

As shown in FIG. 7, in any one of the above embodiments of the present disclosure, the second light emitting control device 400 includes a twelfth transistor T12 and a thirteenth transistor T13. A first terminal of the twelfth transistor T12 is supplied with a first voltage V1, and a second terminal of the twelfth transistor T12 is electrically connected to the first terminal of the drive transistor T0. A third light emitting control signal K3 is inputted to a gate of the twelfth transistor T12 and a gate of the thirteenth transistor T13. A first terminal of the thirteenth transistor T13 is electrically connected to a second terminal of the drive transistor T0, and a second terminal of the thirteenth transistor T13 is electrically connected to a first electrode of the light emitting element 500. A second electrode of the light emitting element 500 is supplied with a second voltage V2.

As shown in FIG. 8, in a case that the amplitude modulation device 200 according to the embodiments of the present disclosure has a structure shown in FIG. 8, the second light emitting control device 400 according to the embodiments of the present disclosure may have other structures. According to the embodiments of the present disclosure, the second light emitting control device 400 includes a tenth transistor. A first terminal of the tenth transistor is electrically connected to a second terminal of the drive transistor T0, a second terminal of the tenth transistor is electrically connected to a first electrode of the light emitting element 500, and a first light emitting control signal is inputted to a gate of the tenth transistor. The first terminal of the drive transistor T0 is supplied with the first voltage V1.

In an embodiment of the present disclosure, the first transistor T1 to the thirteenth transistor T13 according to the present disclosure may be oxide thin film transistors. In one embodiment, the fifth transistor T5, the sixth transistor T6, the seventh transistor T7, and the eighth transistor T8 may be oxide thin film transistors, to reduce a leakage current of the transistors to improve the performance of the pixel driving circuit.

The first transistor T1 to the thirteenth transistor T13 according to the embodiments of the present disclosure may be double-gate transistors to further improve the performance of the pixel driving circuit.

In an embodiment of the present disclosure, the pulse width modulation device shown in FIG. 5 and FIG. 6 may be combined arbitrarily with the amplitude modulation device shown in FIG. 7 and FIG. 8 according to the present disclosure, the first sub-period of the signal generation period of the pulse width modulation device corresponds to the first sub-period of the signal generation period of the amplitude modulation device, and the second sub-period of the signal generation period of the pulse width modulation device corresponds to the second sub-period of the signal generation period of the amplitude modulation device. In a case that the transistors included in the pulse width modulation device and the transistors included in the amplitude modulation device have the same conduction type, the gates of the transistors which are controlled to be turned on in the first sub-period may be electrically connected to the same signal terminal, and the gates of the transistors which are controlled to be turned on in the second sub-period may be electrically connected to the same signal terminal, reducing the number of signal terminals in the pixel driving circuit.

Figure 9:
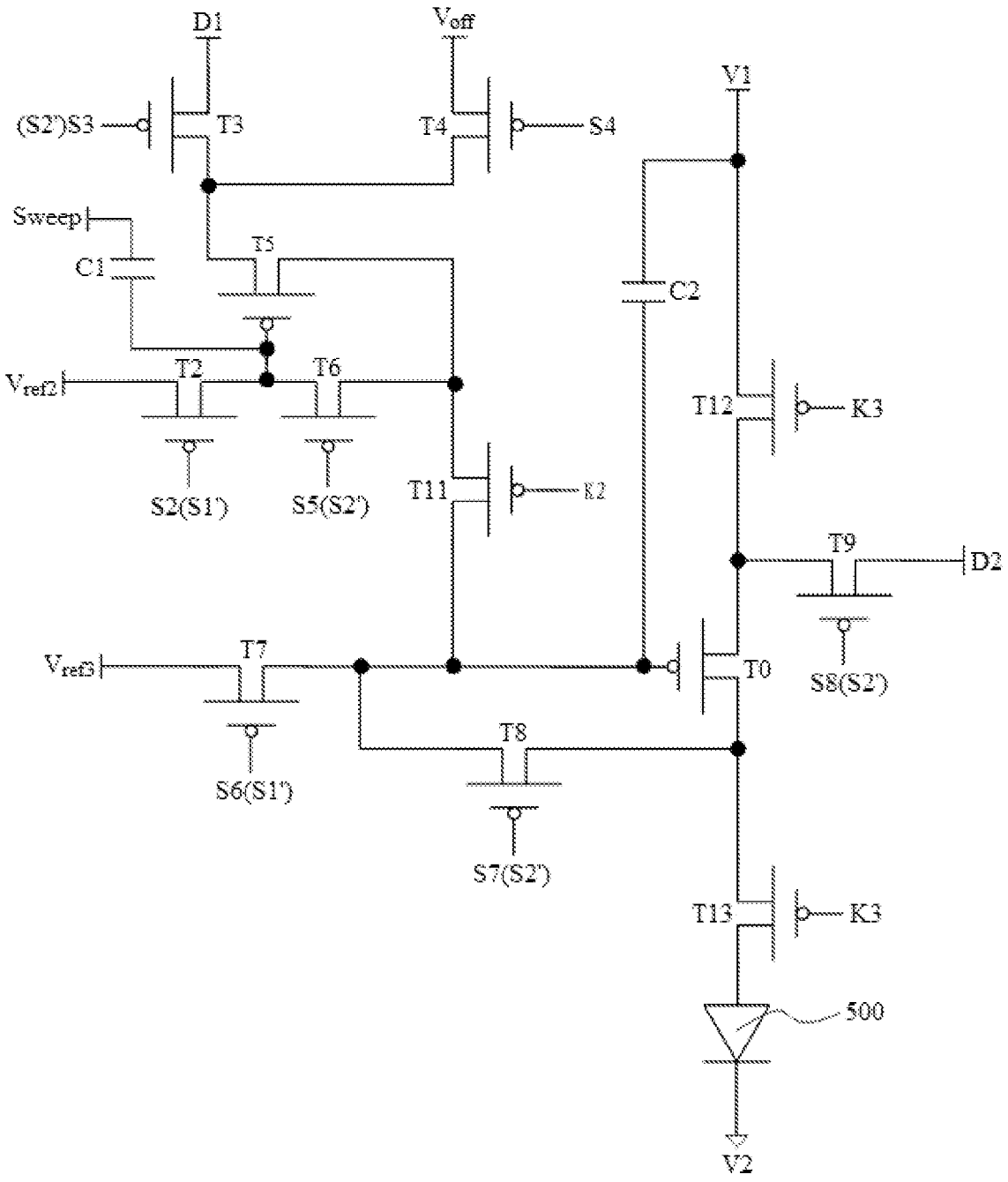
FIG. 9 is a schematic structural diagram of a pixel driving circuit according to another embodiment of the present disclosure.
Figure 10:
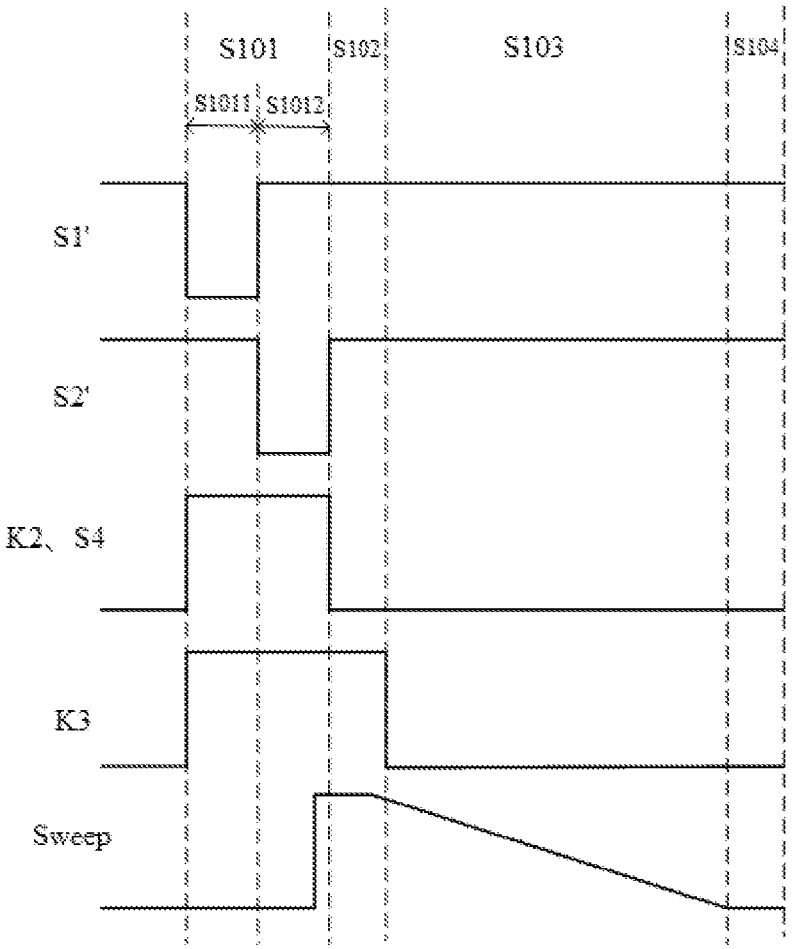
FIG. 10 is a timing diagram according to an embodiment of the present disclosure.

Embodiments according to the present disclosure are described in detail below in conjunction with a pixel driving circuit according to an embodiment shown in FIG. 9 and a control timing of the pixel driving circuit according to an embodiment shown in FIG. 10. FIG. 9 shows a pixel driving circuit having a structure combining the circuit structures shown in FIG. 5 and FIG. 7. FIG. 10 shows a timing diagram of the pixel driving circuit shown in FIG. 9. The description of the present disclosure is provided by taking an example that the transistors included in the other devices and the drive transistor are all P-type transistors. The light emitting element 500 is a light emitting diode. A first electrode of the light emitting element is an anode, and a second electrode of the light emitting element is a cathode. The control signals S2 and S6 may be the same control signal S1', the control signals S3, S5, S7 and S8 are the same control signal S2', and the second light emitting control signal K2 and the fourth control signal S4 are the same control signal. The pulse width control voltage Sweep is a linear falling voltage. A driving method is performed sequentially during a signal generation period S101 (which includes a first sub-period S1011 and a second sub-period S1012), a control processing period S102, a light emitting control period S103, and a light emitting turn-off period S104.

During the first sub-period S1011, the control signal S1' is a low-level signal, and the control signals S2', K2, S4, and K3 are all high-level signals. The second transistor T2 is turned on to transmit the second reference voltage $V_{ref2}$ to the gate of the fifth transistor T5. The seventh transistor T7 is turned on to transmit the third reference voltage $V_{ref3}$ to the gate of the drive transistor T0.

During the second sub-period S1012, the control signal ST is a low-level signal, and the control signals S1', K2, S4, and K3 are all high-level signals. The third transistor T3, the fifth transistor T5 and the sixth transistor T6 are turned on to form a path from the first data voltage D1 to the fifth transistor T5 to raise the voltage of the second electrode plate of the first capacitor C1 until the voltage of the second electrode plate of the first capacitor C1 is raised so that the fifth transistor T5 cannot be maintained in the on state, thus the first terminal of the eleventh transistor T11 is in a high-impedance state and is provided with a floating signal. The ninth transistor T9, the drive transistor T0, and the eighth transistor T8 are turned on to form a path from the second data voltage D2 to the drive transistor T0 to raise the voltage of the second electrode plate of the second capacitor C2 until the voltage of the second electrode plate of the second capacitor C2 is raised so that the drive transistor T0 cannot be maintained in the on state. In this case, the voltage of the second electrode plate of the second capacitor C2 is equal to a voltage of the amplitude setting signal.

During the control processing period S102, the control signals K2 and S4 are low-level signals, and the control signals S1', S2' and K3 are high-level signals. The eleventh transistor T11 transmits a floating signal to the gate of the drive transistor T0. Since the twelfth transistor T12 and the thirteenth transistor T13 are in an off state, the drive transistor T0 cannot be turned on, so that the light emitting element can be driven to emit light after a fluctuation period of the voltage of the gate of the drive transistor during which the eleventh transistor T11 initially transmits the floating signal to the gate of the driving transistor T0 is passed. Under the control of the pulse width control voltage Sweep, the fifth transistor T5 cannot be turned on based on the voltage of the second electrode plate of the first capacitor C1, so that a path from the turn-off voltage signal $V_{off}$ to the drive transistor T0 is maintained in a cut-off state.

During the light emitting control period S103, the control signals K2, S4, and K3 are low-level signals, and the control signals S1' and S2' are high-level signals. The twelfth transistor T12, the drive transistor T0, and the thirteenth transistor T13 are turned on to form a path from the first voltage V1 to the light emitting element 500 and the second voltage V2. The drive transistor T0 outputs a driving current to the first electrode of the light emitting element 500 in response to the signal to the gate of the drive transistor and the signal to the first terminal of the drive transistor, and the light emitting element 500 emits light based on the driving current. Under the control of the pulse width control voltage Sweep, the fifth transistor T5 cannot be turned on based on the voltage of the second electrode plate of the first capacitor C1, so that a path from the turn-off voltage signal $V_{off}$ to the drive transistor T0 is maintained in a cut-off state.

During the light emitting turn-off period S104, since the pulse width control voltage Sweep is a linearly dropping voltage, in the period, the pulse width control voltage Sweep drops and the fifth transistor T5 can be turned on based on the voltage of the second electrode plate of the first capacitor C1, thus a path from the turn-off voltage signal $V_{off}$ to the drive transistor T0 is formed. The turn-off voltage signal $V_{off}$ is transmitted to the gate of the drive transistor T0 to control the drive transistor T0 to be turned off, so that the light emitting element 500 is turned off.

Figure 11:
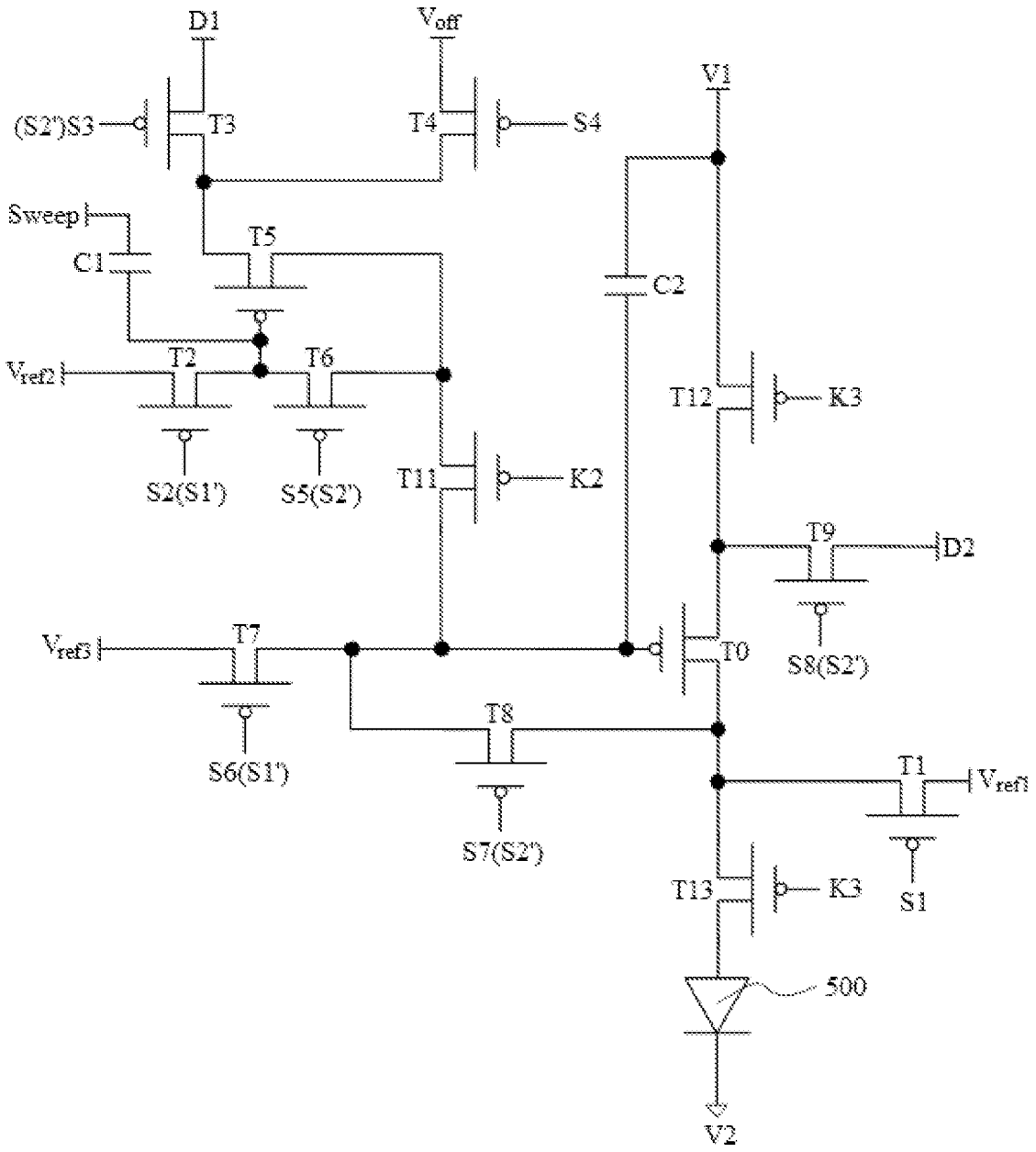
FIG. 11 is a schematic structural diagram of a pixel driving circuit according to another embodiment of the present disclosure.
Figure 12:
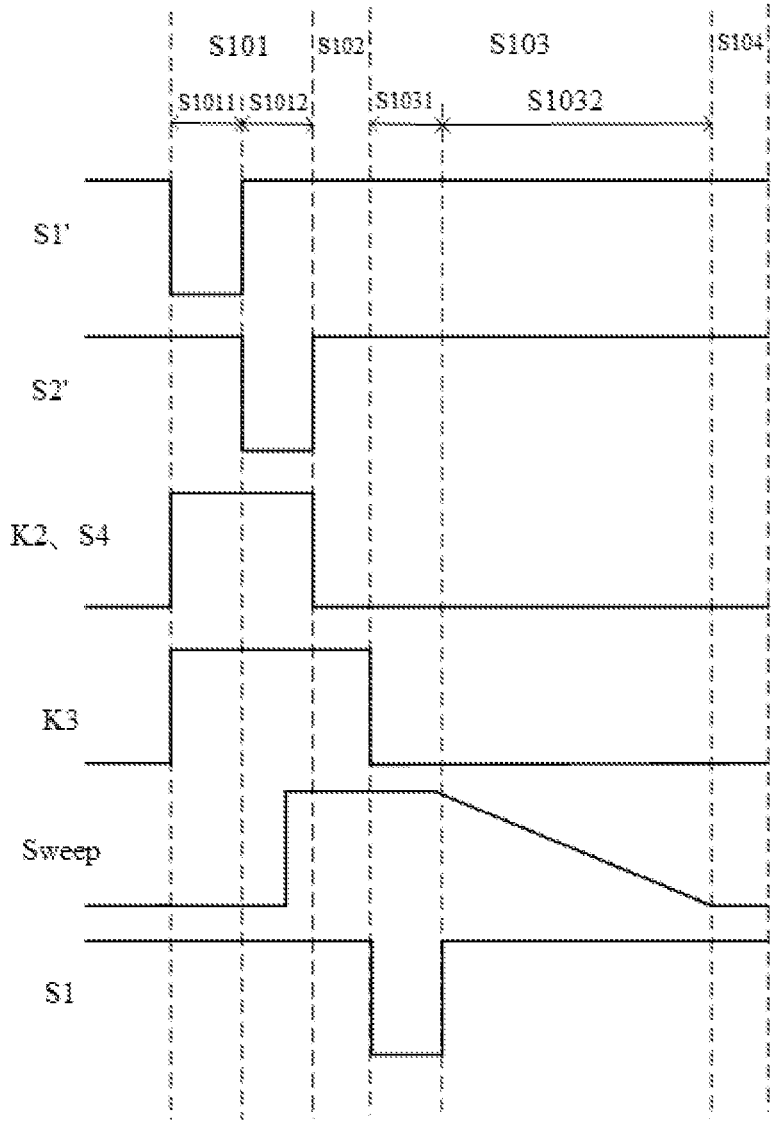
FIG. 12 is a timing diagram according to another embodiment of the present disclosure.

Embodiments according to the present disclosure are described in detail below in conjunction with a pixel driving circuit according to another embodiment shown in FIG. 11 and a control timing of the pixel driving circuit according to another embodiment shown in FIG. 12. FIG. 11 is a schematic structural diagram of a pixel driving circuit in which a delay control device is further arranged based on the structure shown in FIG. 9. Descriptions are made by taking an example that the first transistor T1 included in the delay control device is a P-type transistor. As shown in FIG. 11 and FIG. 12, the driving method is performed sequentially during a signal generation period S101 (which sequentially includes a first sub-period S1011 and a second sub-period S1012), a control processing period S102, a light emitting control period S103 (which includes a delay light emitting sub-period S1031 and a light emitting sub-period S1032), and a light emitting turn-off period S104.

During the first sub-period S1011, the control signal S1' is a low-level signal, and the control signals S1, S2', K2, S4, and K3 are all high-level signals. The second transistor T2 is turned on to transmit the second reference voltage $V_{ref2}$ to the gate of the fifth transistor T5. The seventh transistor T7 is turned on to transmit the third reference voltage $V_{ref3}$ to the gate of the drive transistor T0.

During the second sub-period S1012, the control signal S2' is a low-level signal, and the control signals S1, S1', K2, S4, and K3 are all high-level signals. The third transistor T3, the fifth transistor T5 and the sixth transistor T6 are turned on to form a path from the first data voltage D1 to the fifth transistor T5 to raise the voltage of the second electrode plate of the first capacitor C1 until the voltage of the second electrode plate of the first capacitor C1 is raised so that the fifth transistor T5 cannot be maintained in the on state, thus the first terminal of the eleventh transistor T11 is in a high-impedance state and is provided with a floating signal. The ninth transistor T9, the drive transistor T0, and the eighth transistor T8 are turned on to form a path from the second data voltage D2 to the drive transistor T0 to raise the voltage of the second electrode plate of the second capacitor C2 until the voltage of the second electrode plate of the second capacitor C2 is raised so that the drive transistor T0 cannot be maintained in the on state. In this case, the voltage of the second electrode plate of the second capacitor C2 is equal to a voltage of the amplitude setting signal.

During the control processing period S102, the control signals K2 and S4 are low-level signals, and the control signals S1, S1', S2' and K3 are high-level signals. The eleventh transistor T11 transmits a floating signal to the gate of the drive transistor T0. Since the twelfth transistor T12 and the thirteenth transistor T13 are in an off state, the drive transistor T0 cannot be turned on, so that the light emitting element can be driven to emit light after a fluctuation period of the voltage of the gate of the drive transistor during which the eleventh transistor T11 initially transmits the floating signal to the gate of the driving transistor T0 is passed. Under the control of the pulse width control voltage Sweep, the fifth transistor T5 cannot be turned on based on the voltage of the second electrode plate of the first capacitor C1, so that a path from the turn-off voltage signal $V_{off}$ to the drive transistor T0 is maintained in a cut-off state.

During the delay light emitting sub-period S1031, the control signals S1, K2, S4, and K3 are low-level signals, and the control signals S1' and S2' are high-level signals. The twelfth transistor T12, the drive transistor T0, and the thirteenth transistor T13 are turned on to form a path from the first voltage V1 to the light emitting element 500 and the second voltage V2. The drive transistor T0 outputs a driving current to the first electrode of the light emitting element 500 in response to the signal to the gate of the drive transistor and the signal to the first terminal of the drive transistor. The first transistor T1 is turned on to transmit the first reference voltage $V_{ref1}$ to the first electrode of the light emitting element 500. Due to the first reference voltage $V_{ref1}$, the light emitting element 500 maintains in the off state. Under the control of the pulse width control voltage Sweep, the fifth transistor T5 cannot be turned on based on the voltage of the second electrode plate of the first capacitor C1, so that a path from the turn-off voltage signal $V_{off}$ to the drive transistor T0 is maintained in a cut-off state.

During the light emitting sub-period S1032, the control signals K2, S4, and K3 are low-level signals, and the control signals S1, S1', and S2' are high-level signals. The first transistor T1 is turned off to stop transmitting the first reference voltage $V_{ref1}$ to the first electrode of the light emitting element 500. The light emitting element 500 emits light based on the driving current. Under the control of the pulse width control voltage Sweep, the fifth transistor T5 cannot be turned on based on the voltage of the second electrode plate of the first capacitor C1, so that a path from the turn-off voltage signal $V_{off}$ to the drive transistor T0 is maintained in a cut-off state.

During the light emitting turn-off period S104, since the pulse width control voltage Sweep is a linearly dropping voltage, in the period, the pulse width control voltage Sweep drops and the fifth transistor T5 can be turned on based on the voltage of the second electrode plate of the first capacitor C1, thus a path from the turn-off voltage signal $V_{off}$ to the drive transistor T0 is formed. The turn-off voltage signal $V_{off}$ is transmitted to the gate of the drive transistor T0 to control the drive transistor T0 to be turned off, so that the light emitting element 500 is turned off.

According to the present disclosure, a display panel is further provided. The display panel includes the pixel driving circuit according to any one of the above embodiments.

Figure 13:
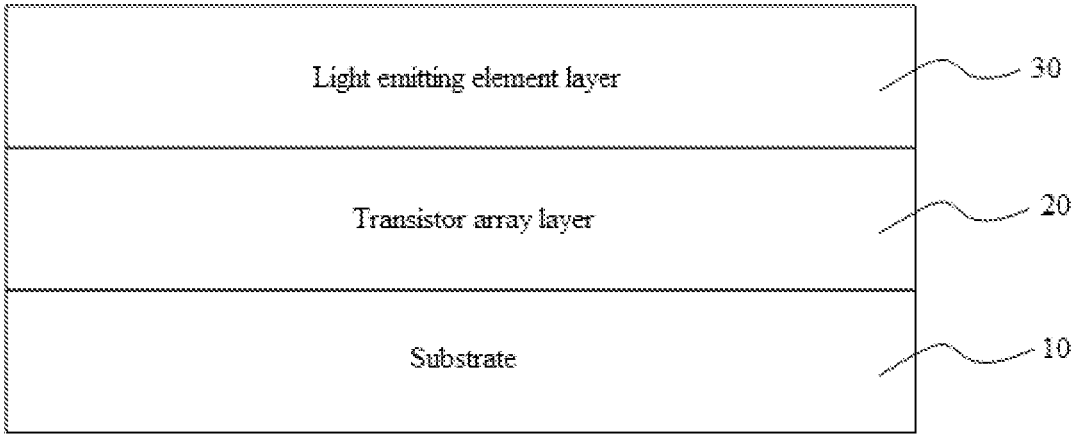
FIG. 13 is a schematic structural diagram of a display panel according to an embodiment of the present disclosure.

Reference is made to FIG. 13, which is a schematic structural diagram of a display panel according to an embodiment of the present disclosure. The display panel includes an array substrate. The array substrate includes: a substrate 10, a transistor array layer 20, and a light emitting element layer 30. The transistor array layer 20 is arranged on a surface of the substrate 10. The pixel driving circuit is arranged in the transistor array layer 20. The light emitting element layer 30 is arranged on a side of the transistor array layer 20 facing away from the substrate.

According to the present disclosure, a display device is further provided. The display device includes the display panel according to the above embodiment.

Figure 14:
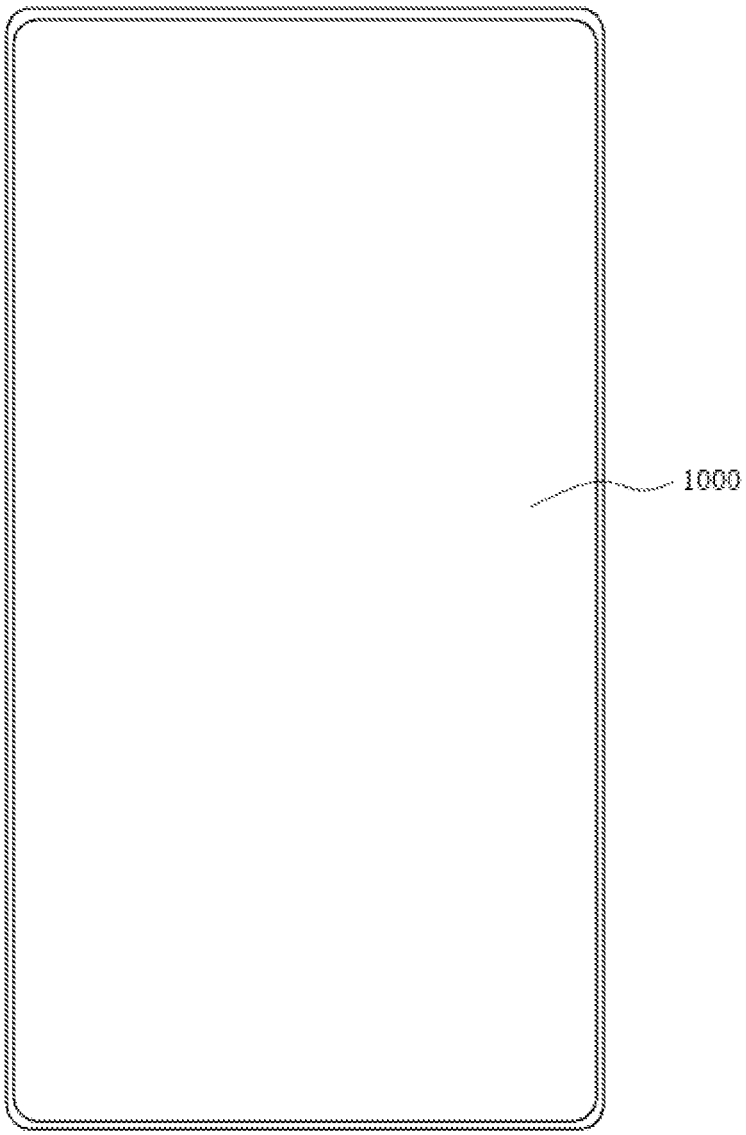
FIG. 14 is a schematic structural diagram of a display device according to an embodiment of the present disclosure.

Referring to FIG. 14, the display device 1000 according to an embodiment of the present disclosure may be a mobile terminal, and the mobile terminal includes the above display panel.

It should be noted that the display device according to the embodiments of the present disclosure may be a notebook, a tablet computer, a computer, a wearable device, and so on, which is not limited in the present disclosure.

According to the embodiments of the present disclosure, a pixel driving circuit and a driving method thereof, a display panel and a display device are provided. The circuit includes: a pulse width modulation device, an amplitude modulation device, a first light emitting control device, a second light emitting control device, a drive transistor, and a light emitting element. During the control processing period, the first light emitting control device controls the floating signal to be transmitted to the gate of the drive transistor for the first predetermined time period. Then, during the light emitting control period, the drive transistor outputs a driving current in response to the signal to the gate of the drive transistor and the signal to the first terminal of the drive transistor, the second light emitting control device controls the driving current to be transmitted to the light emitting element, and the light emitting element emits light based on the driving current.

It can be seen that the second light emitting control device according to the present disclosure is configured to control, in a case that the first light emitting control device controls the floating signal to be transmitted to the gate of the drive transistor for the first predetermined time period, the driving current to be transmitted to the light emitting element, and the light emitting element can emit light. In this way, the light emitting element can be driven to emit light after a fluctuation period of the voltage of the gate of the drive transistor during which the floating signal is initially inputted to the gate of the drive transistor is passed, improving the stability of the pixel driving circuit in driving the light emitting element, thus ensuring an excellent driving effect of the pixel driving circuit on the light emitting element.

What is claimed is:

1. A pixel driving circuit, comprising: a pulse width modulation unit, an amplitude modulation unit, a first light emitting control unit, a second light emitting control unit, a drive transistor, and a light emitting element, wherein the pulse width modulation unit is configured to output a pulse width setting signal to a first terminal of the first light emitting control unit, and the pulse width setting signal comprises a floating signal and a turn-off signal which are sequentially outputted, the amplitude modulation unit is configured to output an amplitude setting signal to a gate of the drive transistor, the drive transistor is configured to output a driving current in response to a signal to the gate of the drive transistor and a signal to a first terminal of the drive transistor, the first light emitting control unit is configured to control the pulse width setting signal to be transmitted to the gate of the drive transistor to control light emitting duration of the light emitting element, the second light emitting control unit is configured to control, in a case that the first light emitting control unit controls the floating signal to be transmitted to the gate of the drive transistor for a first predetermined time period, the driving current to be transmitted to the light emitting element, and the light emitting element is configured to emit light based on the driving current, wherein the pulse width modulation unit comprises: a first reset module, a first data writing module, a first capacitor, a generation module, and a turn-off module, wherein the first reset module is configured to transmit a second reference voltage to a first control terminal of the generation module in response to a second control signal, a first electrode plate of the first capacitor is supplied with a pulse width control voltage, and a second electrode plate of the first capacitor is electrically connected to the first control terminal of the generation module, the first data writing module is configured to transmit a first data voltage to an input terminal of the generation module in response to a third control signal, the turn-off module is configured to transmit a turn-off signal to the input terminal of the generation module in response to a fourth control signal, wherein the turn-off signal is used for turning off the drive transistor to turn the drive transistor into an off state, and the generation module is configured to sequentially output the floating signal and the turn-off signal based on the first data voltage and a voltage of the second electrode plate of the first capacitor and in response to a fifth control signal inputted to a second control terminal of the generation module.

2. The pixel driving circuit according to claim 1, wherein the first predetermined time period is greater than or equal to 0.5 microseconds.

3. The pixel driving circuit according to claim 1, further comprising a delay control unit, wherein the delay control unit is electrically connected to a first electrode of the light emitting element, and the delay control unit is configured to transmit, in response to a first control signal, a first reference voltage to a first electrode of the light emitting element within a second predetermined time period from a time when the second light emitting control unit controls the driving current to be transmitted to the light emitting element.

4. The pixel driving circuit according to claim 3, wherein the delay control unit comprises a first transistor, and wherein the first reference voltage is supplied to a first terminal of the first transistor, a second terminal of the first transistor is electrically connected to the first electrode of the light emitting element, and the first control signal is inputted to a gate of the first transistor.

5. The pixel driving circuit according to claim 3, wherein a sum of the first predetermined time period and the second predetermined time period is greater than or equal to 0.5 microseconds.

6. The pixel driving circuit according to claim 1, wherein the first reset module comprises a second transistor, wherein the second reference voltage is supplied to a first terminal of the second transistor, a second terminal of the second transistor is electrically connected to the first control terminal of the generation module, and the second control signal is inputted to a gate of the second transistor, the first data writing module comprises a third transistor, wherein the first data voltage is supplied to a first terminal of the third transistor, a second terminal of the third transistor is electrically connected to the input terminal of the generation module, and the third control signal is inputted to a gate of the third transistor, the turn-off module comprises a fourth transistor, wherein the turn-off signal is inputted to a first terminal of the fourth transistor, a second terminal of the fourth transistor is electrically connected to the input terminal of the generation module, and the fourth control signal is inputted to a gate of the fourth transistor, and the generation module comprises a fifth transistor and a sixth transistor, wherein a first terminal of the fifth transistor serves as the input terminal of the generation module, a second terminal of the fifth transistor and a second terminal of the sixth transistor are electrically connected together to serve as an output terminal of the generation module, a gate of the fifth transistor and a first terminal of the sixth transistor are electrically connected together to serve as the first control terminal of the generation module, and a gate of the sixth transistor serves as the second control terminal of the generation module.

7. The pixel driving circuit according to claim 6, wherein the third control signal and the fifth control signal are identical to each other and are outputted from a same signal terminal.

8. The pixel driving circuit according to claim 1, wherein the amplitude modulation unit comprises: a second reset module, a second capacitor, a connection module, and a second data writing module, wherein the second reset module is configured to transmit a third reference voltage to the gate of the drive transistor in response to a sixth control signal, a first electrode plate of the second capacitor is supplied with a first voltage, and a second electrode plate of the second capacitor is electrically connected to the gate of the drive transistor, the connection module is configured to electrically connect the gate of the drive transistor and a second terminal of the drive transistor in response to a seventh control signal, and the second data writing module is configured to transmit a second data voltage to the first terminal of the drive transistor in response to an eighth control signal.

9. The pixel driving circuit according to claim 8, wherein the second reset module comprises a seventh transistor, wherein the third reference voltage is supplied to a first terminal of the seventh transistor, a second terminal of the seventh transistor is electrically connected to the gate of the drive transistor, and the sixth control signal is inputted to a gate of the seventh transistor, the connection module comprises an eighth transistor, wherein a first terminal of the eighth transistor is electrically connected to the gate of the drive transistor, a second terminal of the eighth transistor is electrically connected to the second terminal of the drive transistor, and the seventh control signal is inputted to the gate of the drive transistor, and the second data writing module comprises a ninth transistor, wherein the second data voltage is supplied to a first terminal of the ninth transistor, a second terminal of the ninth transistor is electrically connected to the first terminal of the drive transistor, and the eighth control signal is inputted to a gate of the ninth transistor.

10. The pixel driving circuit according to claim 9, wherein the seventh control signal and the eighth control signal are identical to each other and are outputted from a same signal terminal.

11. The pixel driving circuit according to claim 1, wherein the amplitude modulation unit comprises: a third capacitor and a third data writing module, wherein a first electrode plate of the third capacitor is supplied with a first voltage, and a second electrode plate of the third capacitor is electrically connected to the gate of the drive transistor, and the third data writing module is configured to transmit a third data voltage to the gate of the drive transistor in response to a ninth control signal.

12. The pixel driving circuit according to claim 11, wherein the third data writing module comprises a ninth transistor, wherein the ninth control signal is inputted to a gate of the ninth transistor, the third data voltage is supplied to a first terminal of the ninth transistor, and a second terminal of the ninth transistor is electrically connected to the gate of the drive transistor.

13. The pixel driving circuit according to claim 11, wherein the second light emitting control unit comprises a tenth transistor, wherein a first terminal of the tenth transistor is electrically connected to a second terminal of the drive transistor, a second terminal of the tenth transistor is electrically connected to a first electrode of the light emitting element, a first light emitting control signal is inputted to a gate of the tenth transistor, and the first terminal of the drive transistor is supplied with the first voltage.

14. The pixel driving circuit according to claim 1, wherein the first light emitting control unit comprises an eleventh transistor, wherein the pulse width setting signal is inputted to a first terminal of the eleventh transistor, a second terminal of the eleventh transistor is electrically connected to the gate of the drive transistor, and a second light emitting control signal is inputted to a gate of the eleventh transistor.

15. The pixel driving circuit according to claim 1, wherein the second light emitting control unit comprises a twelfth transistor and a thirteenth transistor, wherein a first terminal of the twelfth transistor is supplied with a first voltage, a second terminal of the twelfth transistor is electrically connected to the first terminal of the drive transistor, a third light emitting control signal is inputted to a gate of the twelfth transistor and a gate of the thirteenth transistor, a first terminal of the thirteenth transistor is electrically connected to a second terminal of the drive transistor, a second terminal of the thirteenth transistor is electrically connected to a first electrode of the light emitting element, and a second electrode of the light emitting element is supplied with a second voltage.

16. A driving method, applied to a pixel driving circuit, wherein the pixel driving circuit comprises: a pulse width modulation unit, an amplitude modulation unit, a first light emitting control unit, a second light emitting control unit, a drive transistor, and a light emitting element, and the driving method comprises:

during a signal generation period, outputting, by the pulse width modulation unit, a floating signal to a first terminal of the first light emitting control unit, and outputting, by the amplitude modulation unit, an amplitude setting signal to a gate of the drive transistor;

during a control processing period, controlling, by the first light emitting control unit, the floating signal to be transmitted to the gate of the drive transistor for a first predetermined time period;

during a light emitting control period, outputting, by the drive transistor, a driving current in response to a signal to the gate of the drive transistor and a signal to a first terminal of the drive transistor, controlling, by the second light emitting control unit, the driving current to be transmitted to the light emitting element, and emitting light by the light emitting element based on the driving current; and during a light emitting turn-off period, outputting, by the pulse width modulation unit, a turn-off signal to a first terminal of the first light emitting control unit, and controlling, by the first light emitting control unit, the turn-off signal to be transmitted to the gate of the drive transistor, wherein the pulse width modulation unit comprises: a first reset module, a first data writing module, a first capacitor, a generation module, and a turn-off module, wherein the first reset module is configured to transmit a second reference voltage to a first control terminal of the generation module in response to a second control signal, a first electrode plate of the first capacitor is supplied with a pulse width control voltage, and a second electrode plate of the first capacitor is electrically connected to the first control terminal of the generation module, the first data writing module is configured to transmit a first data voltage to an input terminal of the generation module in response to a third control signal, the turn-off module is configured to transmit a turn-off signal to the input terminal of the generation module in response to a fourth control signal, wherein the turn-off signal is used for turning off the drive transistor to turn the drive transistor into an off state, and the generation module is configured to sequentially output the floating signal and the turn-off signal based on the first data voltage and a voltage of the second electrode plate of the first capacitor and in response to a fifth control signal inputted to a second control terminal of the generation module.

17. The driving method according to claim 16, wherein the pixel driving circuit further comprises the delay control unit, and the light emitting control period comprises a light emitting delay sub-period and a light emitting sub-period, the method further comprises:

during the light emitting delay sub-period, outputting, by the drive transistor, the driving current in response to the signal to the gate of the drive transistor and the signal to the first terminal of the drive transistor, and transmitting, by the delay control unit, the first reference voltage to the first electrode of the light emitting element within the second predetermined time period from the time when the second light emitting control unit controls the driving current to be transmitted to the light emitting element; and during the light emitting sub-period, emitting light by the light emitting element based on the driving current.

18. A display panel, comprising a pixel driving circuit, wherein the pixel driving circuit comprises: a pulse width modulation unit, an amplitude modulation unit, a first light emitting control unit, a second light emitting control unit, a drive transistor, and a light emitting element, wherein the pulse width modulation unit is configured to output a pulse width setting signal to a first terminal of the first light emitting control unit, and the pulse width setting signal comprises a floating signal and a turn-off signal which are sequentially outputted, the amplitude modulation unit is configured to output an amplitude setting signal to a gate of the drive transistor, the drive transistor is configured to output a driving current in response to a signal to the gate of the drive transistor and a signal to a first terminal of the drive transistor, the first light emitting control unit is configured to control the pulse width setting signal to be transmitted to the gate of the drive transistor to control light emitting duration of the light emitting element, the second light emitting control unit is configured to control, in a case that the first light emitting control unit controls the floating signal to be transmitted to the gate of the drive transistor for a first predetermined time period, the driving current to be transmitted to the light emitting element, and the light emitting element is configured to emit light based on the driving current, wherein the pulse width modulation unit comprises: a first reset module, a first data writing module, a first capacitor, a generation module, and a turn-off module, wherein the first reset module is configured to transmit a second reference voltage to a first control terminal of the generation module in response to a second control signal, a first electrode plate of the first capacitor is supplied with a pulse width control voltage, and a second electrode plate of the first capacitor is electrically connected to the first control terminal of the generation module, the first data writing module is configured to transmit a first data voltage to an input terminal of the generation module in response to a third control signal, the turn-off module is configured to transmit a turn-off signal to the input terminal of the generation module in response to a fourth control signal, wherein the turn-off signal is used for turning off the drive transistor to turn the drive transistor into an off state, and the generation module is configured to sequentially output the floating signal and the turn-off signal based on the first data voltage and a voltage of the second electrode plate of the first capacitor and in response to a fifth control signal inputted to a second control terminal of the generation module.

19. A display device, comprising the display panel according to claim 18.

* * * * *